US009783991B2

(12) United States Patent
Richardson et al.

(10) Patent No.: US 9,783,991 B2
(45) Date of Patent: Oct. 10, 2017

(54) STRUCTURE CLADDING TRIM COMPONENTS AND METHODS FOR FABRICATION AND USE OF SAME

(71) Applicant: CFS Concrete Forming Systems Inc., Vancouver (CA)

(72) Inventors: George David Richardson, Vancouver (CA); Semion Krivulin, Richmond (CA); Zi Li Fang, New Westminster (CA)

(73) Assignee: CFS Concrete Forming Systems Inc., Vancouver, British Columbia ( * ) Notice: Subject to any disclaimer, the term of this patent is extended or adjusted under 35 U.S.C. 154(b) by 0 days.

(21) Appl. No.: 15/101,317

(22) PCT Filed: Dec. 5, 2014

(86) PCT No.: PCT/CA2014/051175
§ 371 (c)(1),
(2) Date: Jun. 2, 2016

(87) PCT Pub. No.: WO2015/081445
PCT Pub. Date: Jun. 11, 2015

(65) Prior Publication Data

US 2016/0305130 A1 Oct. 20, 2016

Related U.S. Application Data

(60) Provisional application No. 61/913,192, filed on Dec. 6, 2013.

(51) Int. Cl.
*E04B 2/00* (2006.01)
*E04F 13/073* (2006.01)
(Continued)

(52) U.S. Cl.
CPC ..... *E04F 13/0733* (2013.01); *E04F 13/0846* (2013.01); *E04F 13/18* (2013.01);
(Continued)

(58) Field of Classification Search
CPC ... E04F 13/0733; E04F 19/064; E04F 15/105; E04F 19/0463; E04F 19/062;
(Continued)

(56) References Cited

U.S. PATENT DOCUMENTS 154,179 A 8/1874 Hubert
374,826 A 12/1887 Clarke
(Continued)

FOREIGN PATENT DOCUMENTS

CA 0574720 4/1959
CA 0957816 11/1974
(Continued)

OTHER PUBLICATIONS

Vector Corrosion Technologies Marketing Materials, 2005.
(Continued)

*Primary Examiner* — Basil Katcheves
(74) *Attorney, Agent, or Firm* — Todd A. Rattray; Oyen Wiggs Green & Mutala LLP

(57) ABSTRACT

A cladding kit is provided for a structure cladding, the structure cladding comprising a first panel that extends away from a structure location along a first surface portion of the structure and a second panel that extends away from the structure location along a second surface portion of the structure. The cladding kit comprises a base piece couplable to the structure at the structure location, the base piece comprising a base connector, and a trim piece comprising first and second wings and a trim connector shaped to make a connection with the base connector to thereby couple the trim piece to the base piece. The first wing is shaped to
(Continued)

contact, and be deformed by, the first panel when a connection is made. The second wing is shaped to contact, and be deformed by, the second panel when the connection is made.

25 Claims, 18 Drawing Sheets

(51) Int. Cl.

| | |
|---|---|
| ***E04F 13/08*** | (2006.01) |
| ***E04F 13/18*** | (2006.01) |
| ***E04F 15/10*** | (2006.01) |
| ***E04F 19/04*** | (2006.01) |
| ***E04F 19/06*** | (2006.01) |
| ***E04G 23/00*** | (2006.01) |
| *E04F 15/02* | (2006.01) |
| *E04G 23/02* | (2006.01) |

(52) U.S. Cl.
CPC ..... *E04F 15/105* (2013.01); *E04F 19/0463* (2013.01); *E04F 19/062* (2013.01); *E04F 19/064* (2013.01); *E04F 19/065* (2013.01); *E04G 23/00* (2013.01); *E04F 2015/02122* (2013.01); *E04F 2203/04* (2013.01); *E04G 23/0296* (2013.01)

(58) Field of Classification Search
CPC ..... E04F 13/0846; E04F 19/065; E04F 13/18; E04F 2203/04; E04F 2015/02122; E04G 23/00; E04G 23/0296
USPC ..... 52/287.1, 235, 255, 460, 395
See application file for complete search history.

(56) References Cited

U.S. PATENT DOCUMENTS 510,720 A 12/1893 Stewart, Jr.
820,246 A 5/1906 Nidds
999,334 A 8/1911 Pearson
1,035,206 A 8/1912 Lewen
1,080,221 A 12/1913 Jester
1,175,168 A 3/1916 Moulton
1,244,608 A 10/1917 Hicks
1,276,147 A 8/1918 White
1,345,156 A 6/1920 Flynn
1,423,879 A 7/1922 Potter
1,540,570 A 6/1925 Roberts
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,073,278 A * 3/1937 Hohl ..... E04F 19/06 16/16
2,076,472 A 4/1937 London
2,164,681 A 7/1939 Fould
2,172,052 A 9/1939 Robbins
2,314,448 A 3/1943 Hoggatt
2,326,361 A 8/1943 Jacobsen
2,354,485 A 7/1944 Slaughter
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,063,122 A 11/1962 Katz
3,100,677 A 8/1963 Frank et al.
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A 12/1966 Bowden et al.
3,321,884 A 5/1967 Klaue
3,468,088 A 9/1969 Miller
3,545,152 A 12/1970 Knohl
3,555,751 A 1/1971 Thorgusen
3,588,027 A 6/1971 Bowden
3,667,177 A * 6/1972 Biela ..... A47K 3/008 4/252.1
3,682,434 A 8/1972 Boenig
3,688,460 A * 9/1972 Van Loghem ..... E04F 19/065 277/641
3,769,769 A 11/1973 Kohl
3,788,020 A 1/1974 Gregori
3,822,557 A 7/1974 Frederick
3,886,705 A 6/1975 Cornland
3,951,294 A 4/1976 Wilson
3,959,940 A 6/1976 Ramberg
3,991,636 A 11/1976 Devillers
4,023,374 A 5/1977 Colbert et al.
4,060,945 A 12/1977 Wilson
4,067,155 A * 1/1978 Ruff ..... E04B 1/6803 4/498
4,104,837 A 8/1978 Naito
4,106,233 A 8/1978 Horowitz
4,114,388 A 9/1978 Straub
4,180,956 A 1/1980 Gross
4,182,087 A 1/1980 Schall et al.
4,193,243 A 3/1980 Tiner
4,276,730 A 7/1981 Lewis
4,299,070 A 11/1981 Oltmanns et al.
4,315,390 A * 2/1982 Schaafsma ..... E04F 19/022 52/255
4,332,119 A 6/1982 Toews
4,351,870 A 9/1982 English
4,383,674 A 5/1983 Fricker
4,385,850 A * 5/1983 Bobath ..... F16B 5/0068 403/205
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,601,149 A * 7/1986 Dokan ..... A47K 3/001 428/100
4,606,167 A 8/1986 Thorne
4,664,560 A 5/1987 Cortlever
4,695,033 A 9/1987 Imaeda et al.
4,703,602 A 11/1987 Pardo
4,731,964 A 3/1988 Phillips
4,731,971 A 3/1988 Terkl
4,736,563 A * 4/1988 Bilhorn ..... A01G 9/14 47/17
4,742,665 A 5/1988 Baierl
4,808,039 A 2/1989 Fischer
4,856,754 A 8/1989 Yokota et al.
4,866,891 A 9/1989 Young
4,912,900 A * 4/1990 Yeamans ..... E04D 13/1415 160/395
4,913,576 A * 4/1990 Grant, Jr. ..... A47G 27/045 16/16
4,930,282 A 6/1990 Meadows
4,946,056 A 8/1990 Stannard
4,995,191 A 2/1991 Davis
5,014,480 A 5/1991 Guarriello et al.
5,028,368 A 7/1991 Grau
5,058,855 A 10/1991 Ward
5,078,360 A 1/1992 Spera

(56) References Cited

U.S. PATENT DOCUMENTS 5,106,233 A 4/1992 Breaux
5,124,102 A 6/1992 Serafini
5,155,952 A * 10/1992 Herwegh ..... E04B 1/6803 52/100
5,187,843 A 2/1993 Lynch
5,216,863 A 6/1993 Nessa et al.
5,243,805 A 9/1993 Fricker
5,247,773 A 9/1993 Weir
5,265,750 A 11/1993 Whiteley
5,292,208 A 3/1994 Berger
5,311,718 A 5/1994 Trousilek
5,392,576 A * 2/1995 Yeamans ..... E04D 5/146 160/391
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch
5,608,999 A 3/1997 McNamara
5,625,989 A 5/1997 Brubaker et al.
5,678,383 A * 10/1997 Danielewicz ..... E04D 3/06 52/235
5,714,045 A 2/1998 Lasa et al.
5,729,944 A 3/1998 De Zen
5,740,648 A 4/1998 Piccone
5,747,134 A 5/1998 Mohammed et al.
5,791,103 A 8/1998 Coolman
5,824,347 A 10/1998 Serafini
5,860,262 A 1/1999 Johnson
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lanc
6,167,672 B1 1/2001 Okitomo
6,178,711 B1 1/2001 Laird et al.
6,185,884 B1 2/2001 Myers et al.
6,189,269 B1 2/2001 De Zen
6,205,733 B1 * 3/2001 LaLonde ..... E04B 9/067 52/506.07
6,212,845 B1 4/2001 De Zen
6,219,984 B1 4/2001 Piccone
6,220,779 B1 4/2001 Warner et al.
6,247,280 B1 6/2001 Grinshpun et al.
6,286,281 B1 9/2001 Johnson
6,293,067 B1 9/2001 Meendering
6,357,196 B1 3/2002 McCombs
6,387,309 B1 5/2002 Kojima
6,405,508 B1 6/2002 Janesky
6,435,470 B1 8/2002 Lahham et al.
6,435,471 B1 8/2002 Piccone
6,438,918 B2 8/2002 Moore et al.
6,467,136 B1 10/2002 Graham
6,530,185 B1 3/2003 Scott et al.
6,550,194 B2 4/2003 Jackson et al.
6,588,165 B1 * 7/2003 Wright ..... E04F 19/064 52/459
6,622,452 B2 9/2003 Alvaro
6,691,976 B2 2/2004 Myers et al.
6,694,692 B2 2/2004 Piccone
6,711,870 B1 * 3/2004 Richardson ..... E04D 3/08 52/395
6,832,456 B1 12/2004 Bilowol
6,866,445 B2 3/2005 Semler
6,935,081 B2 8/2005 Dunn et al.
7,320,201 B2 1/2008 Kitchen et al.
7,444,788 B2 11/2008 Morin et al.
7,818,936 B2 10/2010 Morin et al.
8,074,418 B2 12/2011 Thiagarajan et al.
8,099,921 B2 * 1/2012 Muehlebach ..... E04F 19/06 52/396.04
8,136,321 B1 * 3/2012 Bauman ..... E04B 9/0464 52/462
8,485,493 B2 7/2013 Wells et al.
8,707,648 B2 4/2014 Timko et al.
8,769,904 B1 7/2014 Brandt et al.
8,806,839 B2 8/2014 Zhou
8,881,483 B2 11/2014 Caboni
8,882,065 B2 * 11/2014 Henriott ..... A47B 96/067 160/130
8,959,871 B2 2/2015 Parenti et al.
2002/0095895 A1 * 7/2002 Daly ..... E04F 19/062 52/464
2003/0005659 A1 1/2003 Moore, Jr.
2003/0085482 A1 5/2003 Sincock et al.
2003/0155683 A1 8/2003 Pietrobon
2004/0010994 A1 1/2004 Piccone
2004/0020149 A1 2/2004 Messiqua
2004/0093817 A1 5/2004 Pujol Barcons
2004/0216408 A1 11/2004 Hohmann, Jr.
2005/0016083 A1 1/2005 Morin et al.
2005/0016103 A1 1/2005 Piccone
2006/0179762 A1 8/2006 Thome et al.
2006/0185270 A1 8/2006 Handley et al.
2006/0213140 A1 9/2006 Morin et al.
2007/0028544 A1 2/2007 Messiqua et al.
2007/0107341 A1 5/2007 Zhu
2007/0193169 A1 8/2007 Emblin
2008/0168734 A1 7/2008 Degen et al.
2009/0120027 A1 5/2009 Amend
2009/0229214 A1 9/2009 Nelson
2009/0269130 A1 10/2009 Williams
2010/0047608 A1 2/2010 Seccombe
2010/0050552 A1 3/2010 David
2010/0071304 A1 3/2010 Richardson et al.
2010/0251657 A1 10/2010 Richardson et al.
2010/0325984 A1 12/2010 Richardson et al.
2011/0000161 A1 1/2011 Aub
2011/0099932 A1 5/2011 Saulce
2011/0131914 A1 6/2011 Richardson et al.
2011/0277410 A1 11/2011 Richardson
2012/0056344 A1 3/2012 Richardson et al.
2012/0121337 A1 5/2012 Richardson et al.
2013/0081345 A1 4/2013 Sheehy

FOREIGN PATENT DOCUMENTS

CA 1316366 4/1993
CA 2097226 11/1994
CA 2141463 8/1996
CA 2070079 6/1997
CA 2170681 8/1997
CA 2218600 6/1998
CA 2215939 8/1999
CA 2226497 10/1999
CA 2243905 1/2000
CA 2255256 1/2000
CA 2244537 2/2000
CA 2418885 8/2003
CA 2502343 5/2004
CA 2502392 5/2004
CA 2499450 9/2005
CA 2577217 1/2006
CA 2629202 4/2008
CA 2716118 8/2008
CA 2681963 10/2008
CA 2751134 12/2011
CA 2855742 5/2013
CH 317758 1/1957
CH 669235 2/1989
CN 2529936 1/2003
DE 1684357 4/1967
DE 1812590 6/1970
DE 2062723 8/1972
DE 3003446 8/1981
DE 3234489 3/1984
DE 3727956 5/1988
DE 29803155 6/1998
EP 0025420 3/1981
EP 0055504 7/1982

(56) References Cited

FOREIGN PATENT DOCUMENTS

| | | | |
|---|---|---|---|
| EP | 0141782 | | 5/1985 |
| EP | 0179046 | | 4/1986 |
| EP | 0757137 | | 2/1997 |
| EP | 2169133 | | 3/2010 |
| FR | 0507787 | | 7/1920 |
| FR | 1381945 | | 11/1964 |
| FR | 1603005 | | 4/1971 |
| FR | 2364314 | | 4/1978 |
| FR | 2535417 | | 5/1984 |
| FR | 2721054 | | 6/1994 |
| FR | 2717848 | | 9/1995 |
| FR | 2669364 | | 3/2012 |
| GB | 137221 | | 1/1920 |
| GB | 779916 | | 7/1957 |
| GB | 1243173 | | 8/1971 |
| GB | 1253447 | | 11/1971 |
| GB | 2141661 | | 1/1985 |
| GB | 2205624 | | 12/1988 |
| JP | 05133028 | | 5/1993 |
| JP | 09041612 | | 2/1997 |
| JP | 2008223335 | | 9/2008 |
| SE | 206538 | | 8/1966 |
| WO | 9204088 | | 11/1982 |
| WO | 9500724 | | 1/1995 |
| WO | 9607799 | | 3/1996 |
| WO | 9635845 | | 11/1996 |
| WO | 9743496 | | 11/1997 |
| WO | 0163066 | | 8/2001 |
| WO | 0173240 | | 10/2001 |
| WO | 03006760 | | 1/2003 |
| WO | 2004088064 | | 10/2004 |
| WO | 2005040526 | | 5/2005 |
| WO | 2008119178 | | 10/2008 |
| WO | 2009059410 | | 5/2009 |
| WO | 2009092158 | | 7/2009 |
| WO | 2010012061 | | 2/2010 |
| WO | 2010037211 | | 4/2010 |
| WO | 2010078645 | | 7/2010 |
| WO | 2010094111 | A1 | 8/2010 |
| WO | 2012003587 | A1 | 1/2012 |
| WO | 2013075250 | A1 | 5/2013 |
| WO | 2013075251 | A1 | 5/2013 |
| WO | 2013102274 | A1 | 7/2013 |
| WO | 2013102275 | A1 | 7/2013 |
| WO | 2013177715 | A1 | 12/2013 |

OTHER PUBLICATIONS

Vector Corrosion Technologies Marketing Materials, 2007.
Vector Corrosion Technologies Marketing Materials, 2008.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.
The Digigraph System, http://www.digigraph-housing.com/web/system.ht, accessed online Jan. 2012.

* cited by examiner

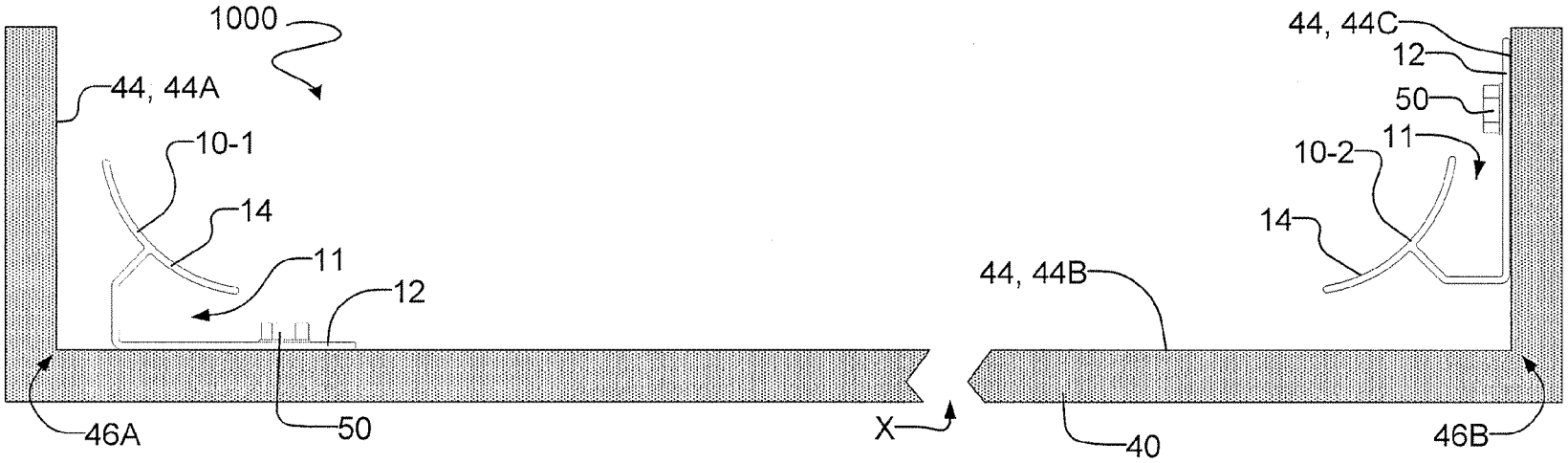
FIG. 1A – Prior Art
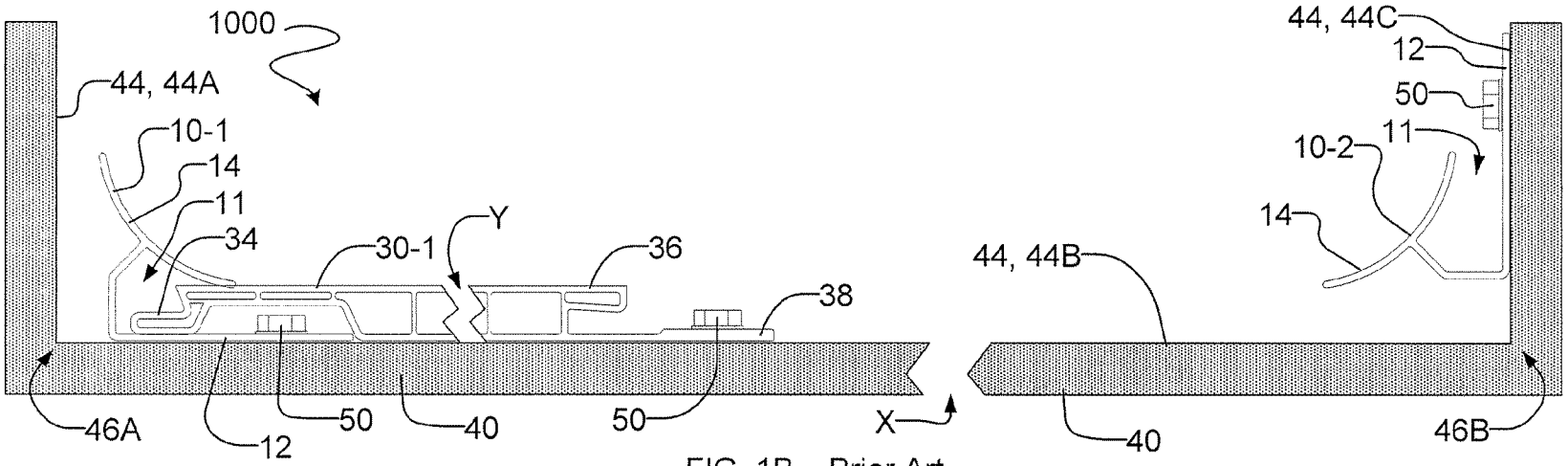
FIG. 1B – Prior Art

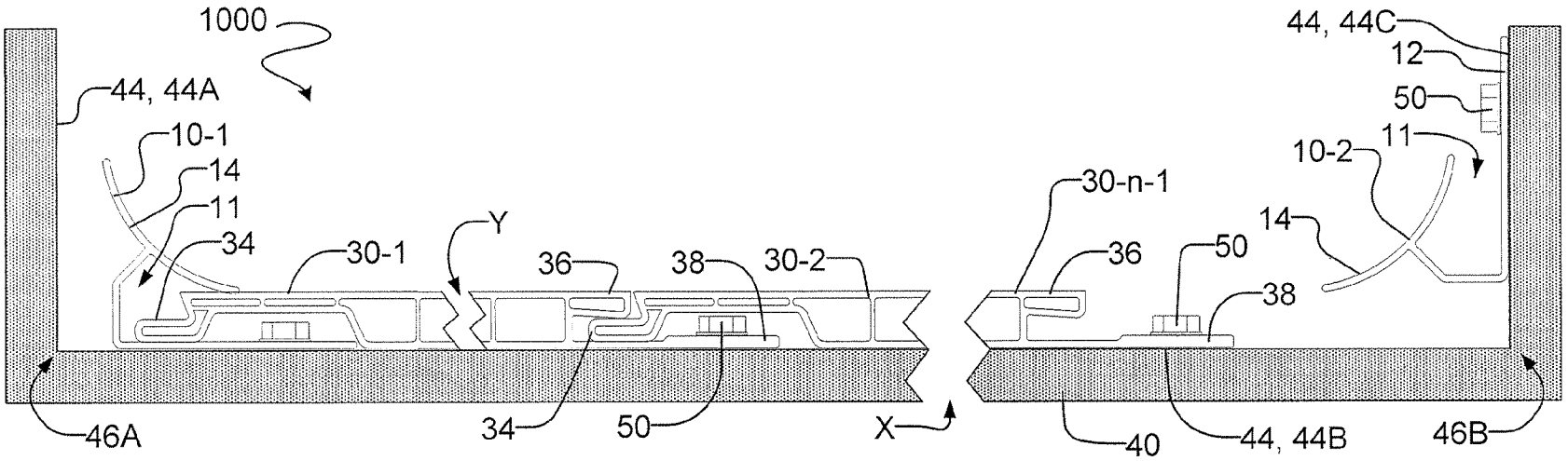
FIG. 1C – Prior Art
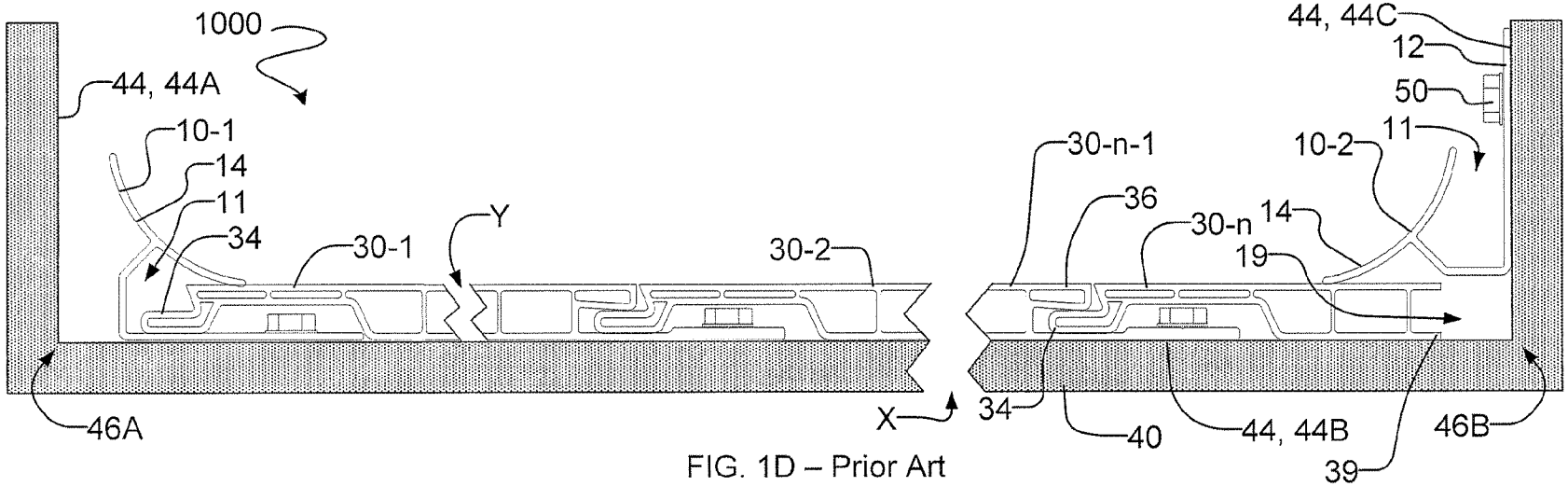
FIG. 1D – Prior Art

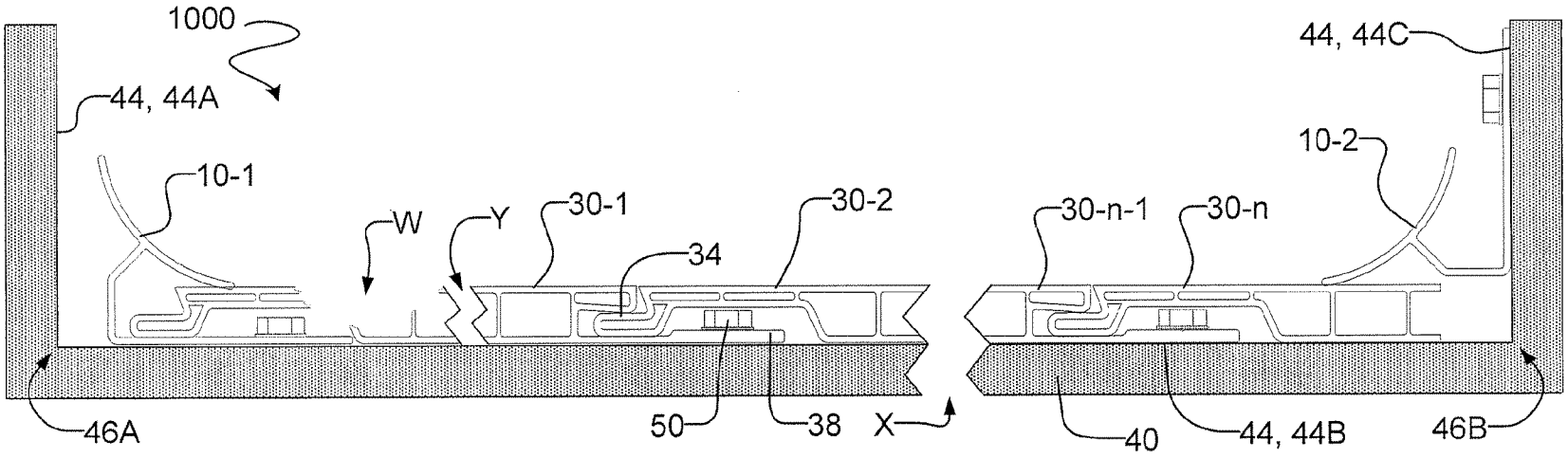
FIG. 2A – Prior Art
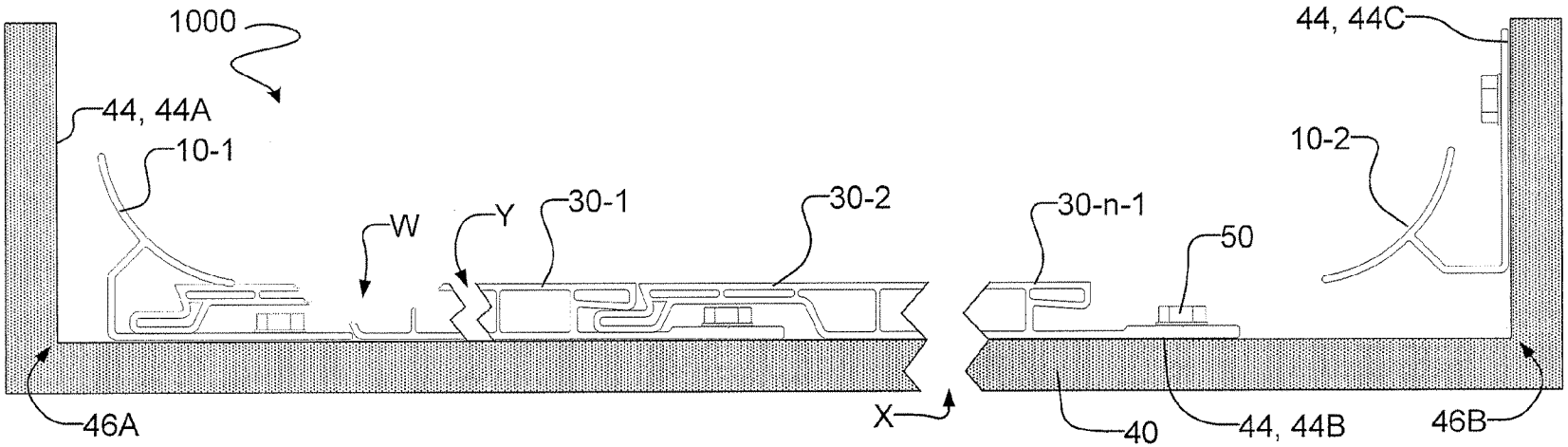
FIG. 2B – Prior Art

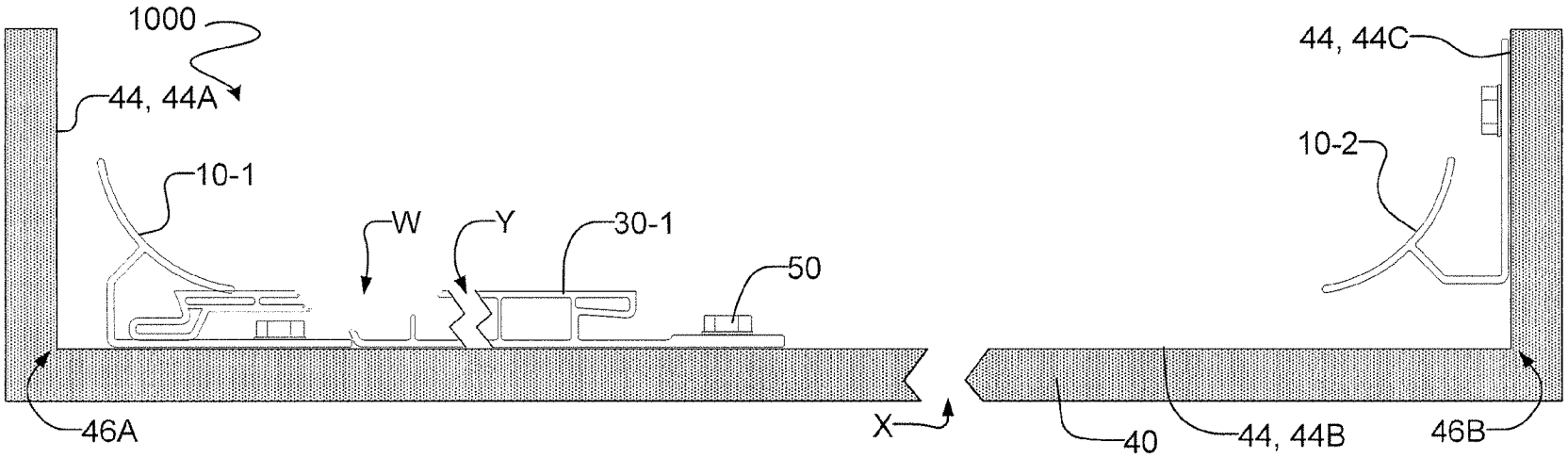
FIG. 2C – Prior Art
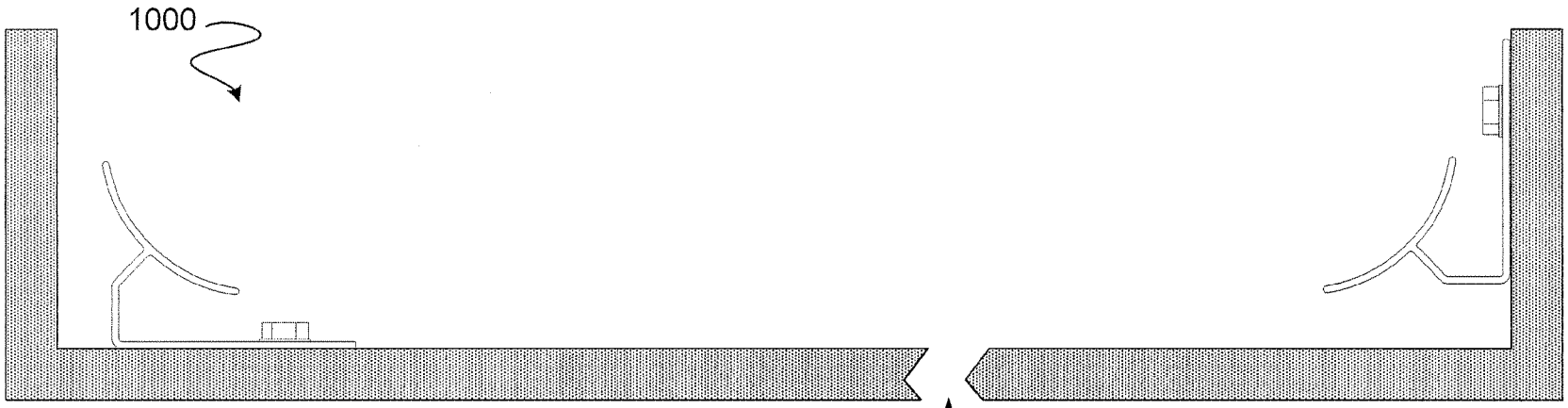
FIG. 2D – Prior Art

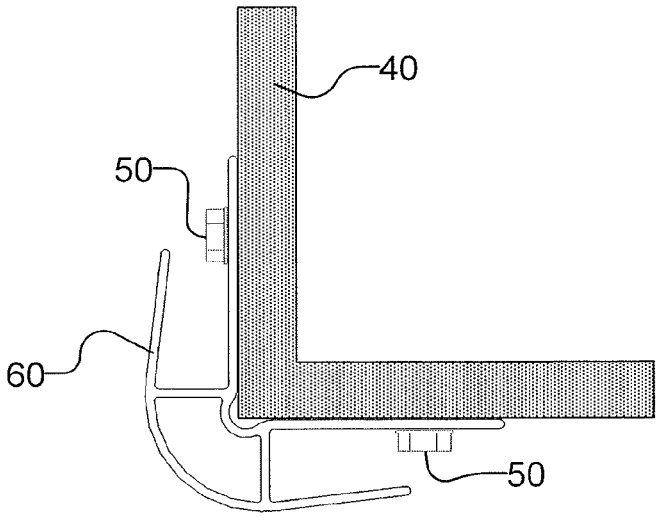
FIG. 3 – Prior Art
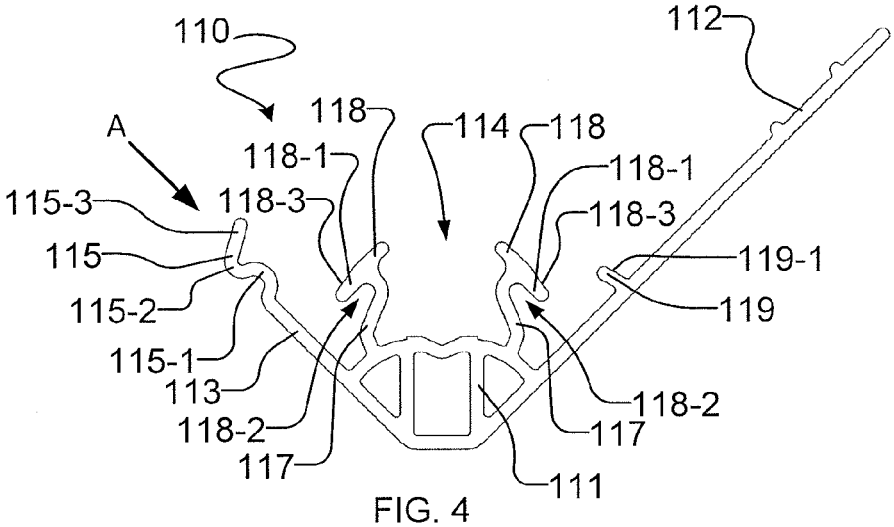
FIG. 4
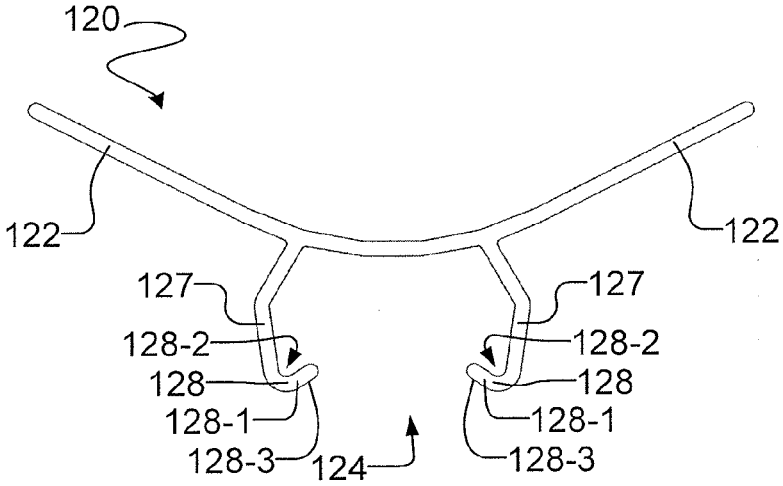
FIG. 5

STRUCTURE CLADDING TRIM COMPONENTS AND METHODS FOR FABRICATION AND USE OF SAME

RELATED APPLICATIONS

This application claims the benefit of the priority of US patent application No. 61/913,192 filed 6 Dec. 2013 which is hereby incorporated herein by reference.

TECHNICAL FIELD

This invention relates to structure claddings. Particular embodiments of the invention provide structure claddings and methods and apparatus for installing and repairing structure claddings.

BACKGROUND

It is known to clad structures with structure claddings. Structure claddings typically include a plurality of longitudinally and transversely extending panels, each having one end configured to attach to the structure and another end configured to engage an adjacent panel.

Well-known problems with prior art structure claddings of this nature include the difficulties of installation and repair.

FIGS. 1A-1D are top cross-sectional views illustrating a number of steps involved in installing a portion of a prior art structure cladding 1000. Structure cladding 1000 clads a portion of surface 44 of structure 40. Surface 44 comprises surface portions 44A, 44B, and 44C. Surfaces portions 44A and 44B meet at corner 46A. Surface portions 44B and 44C meet at corner 46B.

The illustrated portion of structure cladding 1000, as seen in FIG. 1D, includes a first inside corner piece 10-1 at corner 46A, a second inside corner piece 10-2 at corner 46B, and a plurality of panels 30-1, 30-2, . . . **30-*n*-1, 30-*n* (together, panels 30) along surface portion 44**B.

Break X indicates that structure 40 may be of any suitable length and any suitable number of panels 30 may extend along surface portion 44B of structure 40. Break Y indicates that panels 30 may be of any suitable length.

Panels 30 extend in longitudinal directions (i.e. into and out of the page in the views in FIGS. 1A-1D) transverse directions along surface portion 44B of structure 40. Structure cladding 1000 is mounted to structure 40 by a plurality of fasteners 50.

Referring to FIG. 1A, each inside corner piece 10 has a curved portion 14 and a mounting tab 12. The space between curved portion 14 and mounting tab 12 defines a receptacle 11. Referring to FIG. 1A, each panel 30 comprises transversely opposed male end 34 and female end 36. Female end 36 comprises a mounting tab 38.

In FIG. 1A, inside corner pieces 10-1 and 10-2 are attached to structure 40 by fasteners 50 which extend through their mounting tabs 12. Typically, there will be a plurality of fasteners 50 spaced apart from one another along the longitudinal dimensions of inside corner pieces 10-1 and 10-2 (i.e. spaced along the dimension into and out of the page and therefore not visible in the views of FIGS. 1A-1D).

In FIG. 1B, male end 34 of panel 30-1 is inserted into receptacle 11 of inside corner piece 10-1, so that male end 34 of panel 30-1 covers fasteners 50 used to attach corner piece 10-1 to structure 40. Panel 30-1 is attached to structure 40 by fasteners 50 which extend through mounting tab 38. Like fasteners 50 used to mount corner pieces 10-1 and 10-2, typically there will be a plurality of fasteners 50 spaced apart from one another along the longitudinal dimension of mounting tab 38 (i.e. spaced along the dimension into and out of the page and therefore not visible in the views of FIGS. 1A-1D).

In FIG. 1C, the male end 34 of panel 30-2 is inserted into the female end 36 of panel 30-1 so that male end 34 of panel 30-2 covers fasteners 50 used to attach panel 30-1 to structure 40. Mounting tab 38 of panel 30-2 is attached to structure 40 by fasteners 50 in a manner similar to the attachment of panel 30-1 described above (due to break X, this is not visible in FIGS. 1A-1D).

Any suitable number of panels 30 (e.g. panels 30-1, 30-2, . . . **30-*n*-1, 30-*n***) may be installed adjacent to one another in this manner.

In FIG. 1C, a portion of panel **30-*n*-1 is shown. The mounting tab 38 of panel 30-*n*-1 is attached to structure 40 by fasteners 50 in a manner similar to the attachment of panel 30-1** described above.

In FIG. 1D, panel **30-*n* is cut to fit into the transverse space between panel 30-*n*-1 and corner 46B. Panel 30-*n* must be deformed so that male end 34 of panel 30-*n* can be inserted into female end 36 of panel 30-*n*-1 while cut end 39 of panel 30-*n* is inserted into the space 19 between curved portion 14 of corner piece 10-*n*-1 and surface portion 44B of structure 40**.

Installation of panel **30-*n* is difficult. If panel 30-*n* is cut too long, it is not possible to deform panel 30-*n* enough to insert its male end 34 into the female end 36 of panel 30-*n*-1 while simultaneously inserting its cut end 39 into space 19. If panel 30-*n* is cut too short, it is prone to falling out after being installed. The material of panel 30-*n* may be relatively stiff and it may require significant force to deform panel 30-*n* into its installed position, particularly when the transverse dimension of panel 30-*n* is relatively small. The deformation of panel 30-*n* may damage panel 30-*n*. Further, the restorative forces associated with deforming panel 30-*n* can cause damage to corner piece 10-2**.

FIGS. 2A-2D are top cross-sectional views illustrating a number of steps involved in repairing prior art structure cladding 1000 once structure cladding 1000 has been installed.

In FIG. 2A, panel 30-1 of structure cladding 1000 has a damaged portion W. Panel 30-1 needs to be replaced, but panel 30-1 cannot be removed (i.e. detached from structure 40) without first removing panel 30-2, because the fasteners 50 attaching panel 30-1 to structure 40 are covered by male end 34 of panel 30-2. Similarly, panel 30-2 cannot be removed without removing all the panels up to and including panel **30-*n***.

In FIG. 2B, panel **30-*n* is removed. Recall from the discussion of FIGS. 1A-1D above that panel 30-*n* is a cut panel and must be deformed to be installed. Consequently, it may be necessary to cut panel 30-*n* to remove it, in which case the repair of structure 1000 will ultimately require a replacement panel for panel 30-*n***.

In FIG. 2C, panels **30-*n*-1, . . . 30-2 are be sequentially removed (i.e. detached from structure 40) by unfastening fasteners 50 that attach these panels 30-*n*-1, . . . 30-2 to structure 40. At the conclusion of the step shown in FIG. 2C, the only panel left to be removed is damaged panel 30-1**.

In FIG. 2D, damaged panel 30-1 is removed. Panel 30-1 may be removed by unfastening fasteners 50 that attach panel 30-1 to structure 40. A replacement panel may now be used to replace damaged panel 30-1. Panels 30-2, . . . **30-*n*-1, 30-*n* may then be sequentially re-installed using the method described above and illustrated in FIGS. 1A-1**D.

For structure claddings with large numbers of panels, it may be very time consuming to sequentially remove all of the panels necessary to reach a damaged panel, and to re-install all of the removed panels.

FIG. 3 is a top cross-sectional view of an example of a prior art outside corner piece 60. Outside corner piece 60 is mounted by fasteners 50 to structure 40. Outside corner piece 60 can be used in a similar manner as inside corner piece 10.

There is a general desire for improved structure claddings and for improved methods for installing and/or repairing structure claddings.

The foregoing examples of the prior art and limitations related thereto are intended to be illustrative and not exclusive. Other limitations of the prior art will be apparent to those skilled in the art upon a reading of the specification and a study of the drawings.

SUMMARY

The following embodiments and aspects thereof are described and illustrated in conjunction with apparatus and methods which are meant to be exemplary and illustrate, not limiting in scope. In various embodiments, one or more of the above-described problems have been reduced or eliminated, while other embodiments are directed to other improvements.

One aspect of the invention provides a cladding kit for a structure cladding, the structure cladding comprising a first panel that extends away from a structure location along a first surface portion of the structure and a second panel that extends away from the structure location along a second surface portion of the structure, the first and second surface portions on opposed sides of the structure location. The structure location may be a corner. The cladding kit comprises: a base piece couplable to the structure at the structure location, the base piece comprising a base connector; and a trim piece comprising first and second wings and a trim connector shaped to make a connection with the base connector to thereby couple the trim piece to the base piece. The first wing is shaped to contact, and be deformed by, the first panel when the connection is made and to exert restorative force against the first panel after the connection is made. The second wing is shaped to contact, and be deformed by, the second panel when the connection is made and to exert restorative force against the second panel after the connection is made.

Another aspect of the invention provides a cladding apparatus for a structure cladding, the structure cladding comprising a first panel that extends away from a structure location along a first surface portion of the structure and a second panel that extends away from the structure location along a second surface portion of the structure, the first and second surface portions on opposed sides of the structure location. The structure location may be a corner. The cladding apparatus comprises: a base piece coupled to the structure at the structure location, the base piece comprising a base connector, and a trim piece comprising first and second wings and a trim connector coupled to the base connector to form a connection therebetween and to thereby couple the trim piece to the base piece. The first wing is shaped to contact, and be deformed by, the first panel when the connection is made between the trim connector and the base connector and to exert restorative force against the first panel after the connection is made The second wing is shaped to contact, and be deformed by, the second panel when the connection is made between the trim connector and the base connector and to exert restorative force against the second panel after the connection is made.

Another aspect of the invention provides a method for lining a corner of a structure with a structure cladding, the structure cladding comprising a first panel that extends away from the corner of the structure along a first surface portion of the structure and a second panel that extends away from the corner of the structure along a second surface portion of the structure, the first and second surface portions on opposed sides of the corner. The method comprises: coupling a base piece to the structure at the corner of the structure; providing a trim piece comprising first and second wings; and coupling the trim piece to the base piece to make a connection therebetween. Coupling the trim piece to the base piece to make the connection comprises: contacting the first wing to the first panel and exerting force which causes the contact between the first wing and the first panel to deform the first wing, and contacting the second wing to the second panel and exerting force which causes the contact between the second wing and the second panel to deform the second wing. After the connection is made between the trim piece and the base piece, the first wing exerts restorative force against the first panel and the second wing exerts restorative force against the second panel.

Another aspect of the invention provides a method for replacing at least a portion of a particular panel of a structure cladding, the structure cladding comprising a plurality of edge-adjacent panels which line a surface of a structure. The method comprises: removing a first portion of the particular panel from the surface of the structure to leave a remaining portion of the particular panel attached to the surface of the structure; mounting a base piece to the structure at a base location adjacent to the remaining portion of the particular panel; locating a replacement panel along the surface of the structure at a replacement panel location, the replacement panel location on a side of the base piece opposite that of the remaining portion of the particular panel; and coupling a trim piece comprising a first wing to the base piece to form a connection therebetween. Coupling the trim piece to the base piece comprises contacting the first wing to the replacement panel and exerting force which causes the contact between the first wing and the replacement panel to deform the first wing. After the connection is made between the trim piece and the base piece, the first wing exerts restorative force against the replacement panel.

In addition to the exemplary aspects and embodiments described above, further aspects and embodiments will become apparent by reference to following detailed description and study of the drawings.

BRIEF DESCRIPTION OF DRAWINGS

Exemplary embodiments are illustrated in referenced figures of the drawings. It is intended that the embodiments and figures disclosed herein are to be considered illustrative rather than restrictive.

In drawings which depict non-limiting embodiments of the invention:

FIGS. 1A-1D are top cross-sectional views illustrating the steps of installing a prior art structure cladding;

FIGS. 2A-2D are top cross-sectional views illustrating the steps of repairing a prior art structure cladding;

FIG. 3 is a top cross-sectional view of a prior art outside corner piece;

FIG. 4 is a top cross-sectional view of an inside corner base piece of a structure cladding according to a particular embodiment;

FIG. 5 is a top cross-sectional view of an inside corner trim piece of a structure cladding, which may be use used together with the FIG. 4 inside corner base piece according to a particular embodiment;

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 8A:
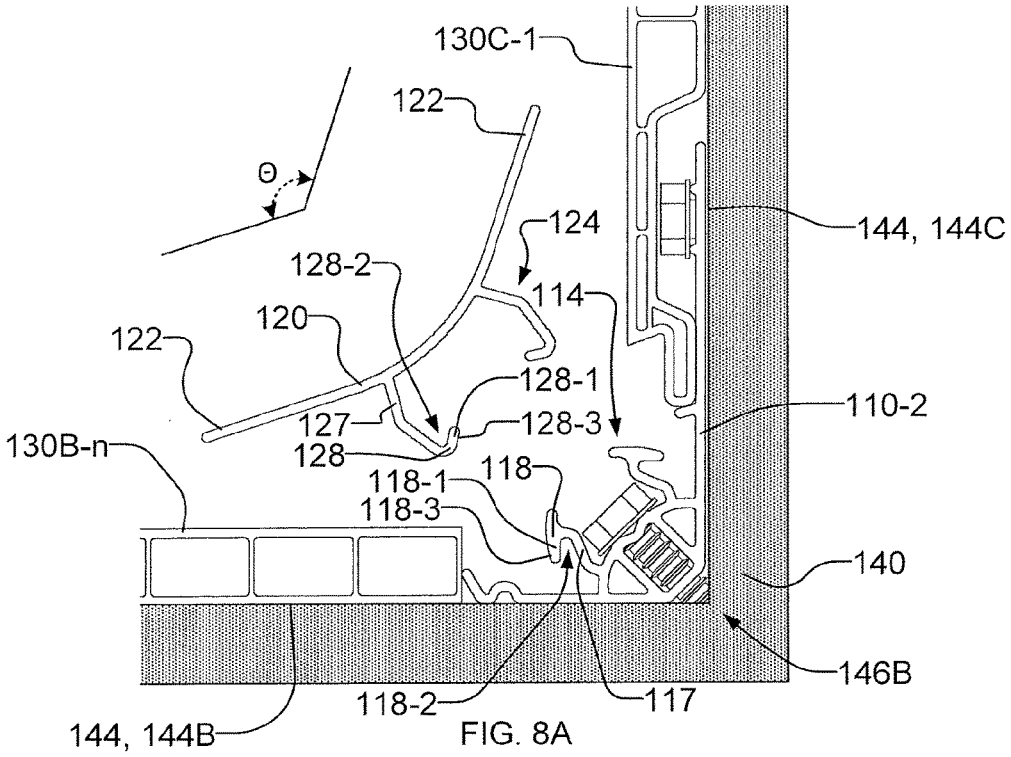
FIGS. 8A and 8B are top cross-sectional views illustrating the FIG. 5 inside corner trim piece connecting to the FIG. 4 inside corner base piece according to a particular embodiment.
Figure 8B:
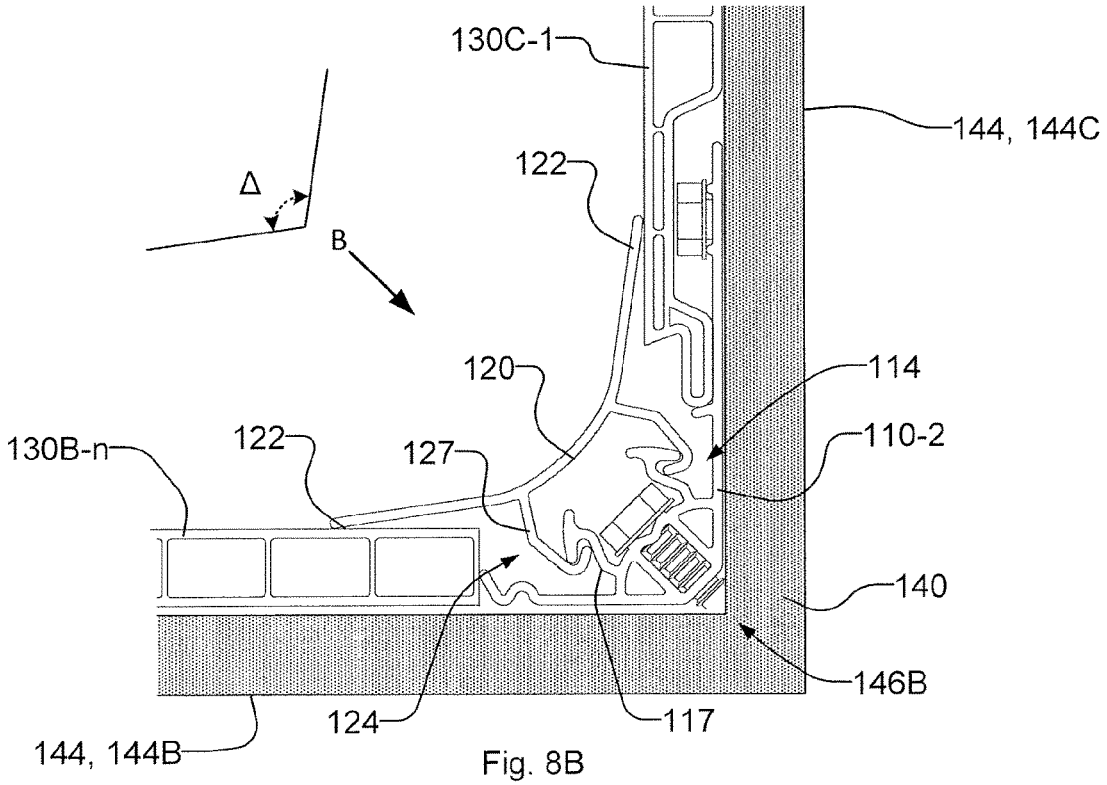

FIG. 4 is a top cross-sectional view of an inside corner base piece 110 which may be used in a structure cladding 2000 (FIGS. 6A-6F) according to a particular embodiment. FIGS. 8A and 8B are top cross-sectional views of inside corner base piece 110 in use. Base piece 110 of the illustrated embodiment is suitable for use on an "inside corner" of a structure 140 to be cladded (e.g. a corner where the surface portions to be cladded form a corner of approximately 90 degrees), although it will be appreciated from the following description that base piece 110 may be used on inside corners which are not precisely 90 degrees by suitable deformation of base piece 110. Additionally or alternatively, base pieces similar to base piece 110 could be designed for other corner angles.

Base piece 110 comprises a structural central component 111 supporting a mounting tab 112 and an extending tab 113 which extend from central component 111. Extending tab 113 comprises deformation component 115 at an end distal from central component 111. Deformation component 115 may be shaped such that when a force is applied against deformation component 115 in direction A, deformation component 115 may contract in direction A and may exert restorative force opposed to direction A.

Deformation component 115 may comprise the "zig zag" shape shown in FIG. 4 having a plurality (e.g. two) of corners 115-1, 115-2. When a force is applied against deformation component 115 in direction A, the angle formed by corners 115-1 and 115-2 of the "zig zag" shape may decrease, so that the overall length of deformation component 115 in direction A is decreased. Because of the "zig-zag" shape of deformation component 115, the amount of deformation in direction A may be relatively large with a relatively small amount of deformation to corners 115-1, 115-2. Deformation component 115 may comprise other shapes (e.g. the "hockey stick" shape of deformation component 163, as discussed below), structures, and materials. For example, in some embodiments, deformation component 115 made be fabricated from elastomeric material which may be different from the other portions of base piece 110.

The tip 115-3 of deformation component 115 may be bevelled to extend away from surface portion 144B of structure 140 to be cladded (see FIG. 8A) as it extends transversely away from central component 111. This bevelled shape of tip 115-3 allows deformation component 115 to guide a cut end of a panel toward surface portion 144B of structure 140 to be cladded (see FIG. 8A), as discussed in greater detail below.

Base piece 110 of the illustrated embodiment comprises a nub 119 with a beveled edge 119-1. Nub 119 may provide a physical indicator of the correct placement of a panel 130C-1 (see FIG. 8A) relative to base piece 110. Nub 119 is discussed in greater detail below.

Inside corner base piece 110 comprises a connector 114 for connecting to a complementary connector of an inside corner trim piece 120, as explained below. Connector 114 of the illustrated embodiment comprises a plurality (e.g. two) of arms 117. In the illustrated embodiment, each of arms 117 comprises a hooked portion 118. Hooked portions 118 comprise hook protrusions 118-1 that define hook concavities 118-2. Hook concavities 118-2 open toward mounting tab 112 and extending tab 113, respectively (i.e. toward surface portions 144B and 144C, respectively, of structure 140 to be cladded (see FIG. 8A)). Hook protrusions 118-1 define bevelled surfaces 118-3 which, in the illustrated embodiment, extend toward one another as they extend away from surface portions 144B and 144C, respectively, of structure 140 to be cladded (see FIG. 8A).

FIG. 5 is a top cross-sectional view of an inside corner trim piece 120 of a structure cladding according to a particular embodiment. FIGS. 8A and 8B are top cross-sectional views of inside corner trim piece 120 in use. Trim piece 120 comprises two transversely extending wings 122. Trim piece 120 also comprises a connector 124 for connecting to complementary connector 114 of base piece 110. Connector 124 of the illustrated embodiment comprises a plurality (e.g. two) of arms 127. In the illustrated embodiment, each of arms 127 comprises a hooked portion 128. Hooked portions 128 comprise hook protrusions 128-1 that define hook concavities 128-2. Hook concavities 128-2 open toward wings 122, respectively (i.e. away from surface portions 144B and 144C, respectively, of structure 140 to be cladded (see FIG. 8A)). Hook protrusions 128-1 define bevelled surfaces 128-3 which, in the illustrated embodiment, extend toward one another as they extend away from surfaces 144B and 144C, respectively, of structure 140 to be cladded (see FIG. 8A).

FIGS. 6A-6F are top cross-sectional views illustrating a number of steps involved in installing a structure cladding 2000 to clad a portion of a structure 140 according to a particular embodiment. Structure cladding 2000 clads a portion of a surface 144 of a structure 140. Surface 144 has first surface portion 144A, second surface portion 144B, and third surface portion 144C. Surface portions 144A and 144B meet at corner 146A. Surface portions 144B and 144C meet at corner 146B.

Figure 6A:
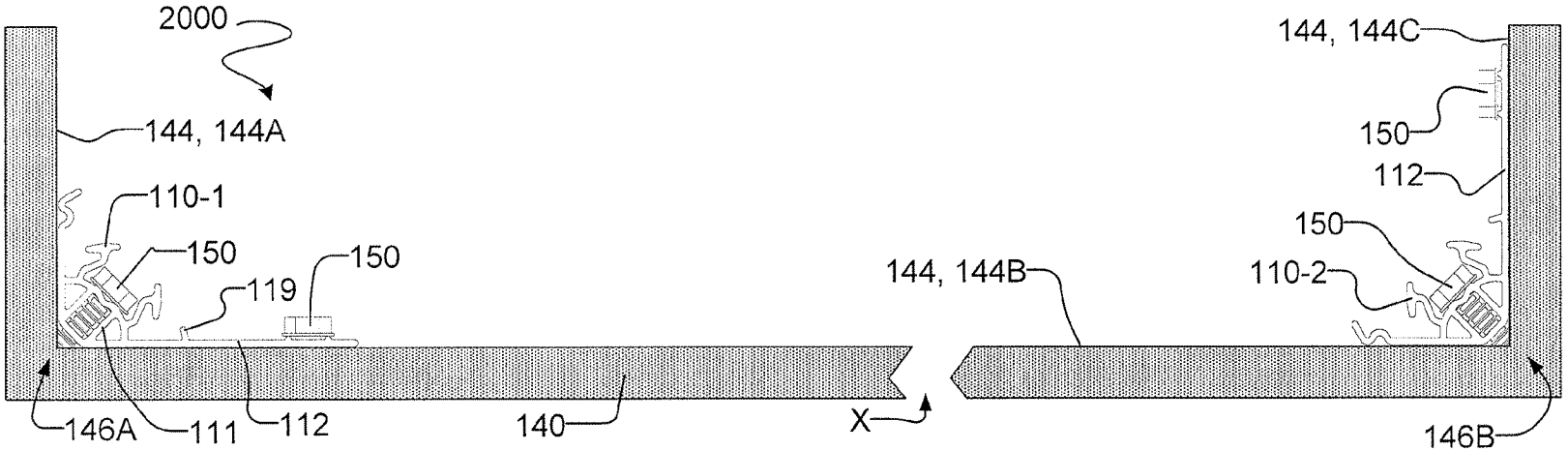
FIGS. 6A-6F are top cross-sectional views illustrating a number of steps involved in installing a portion of a structure cladding using the FIG. 4 inside corner base piece and the FIG. 5 inside corner trim piece according to a particular embodiment.
Figure 6B:
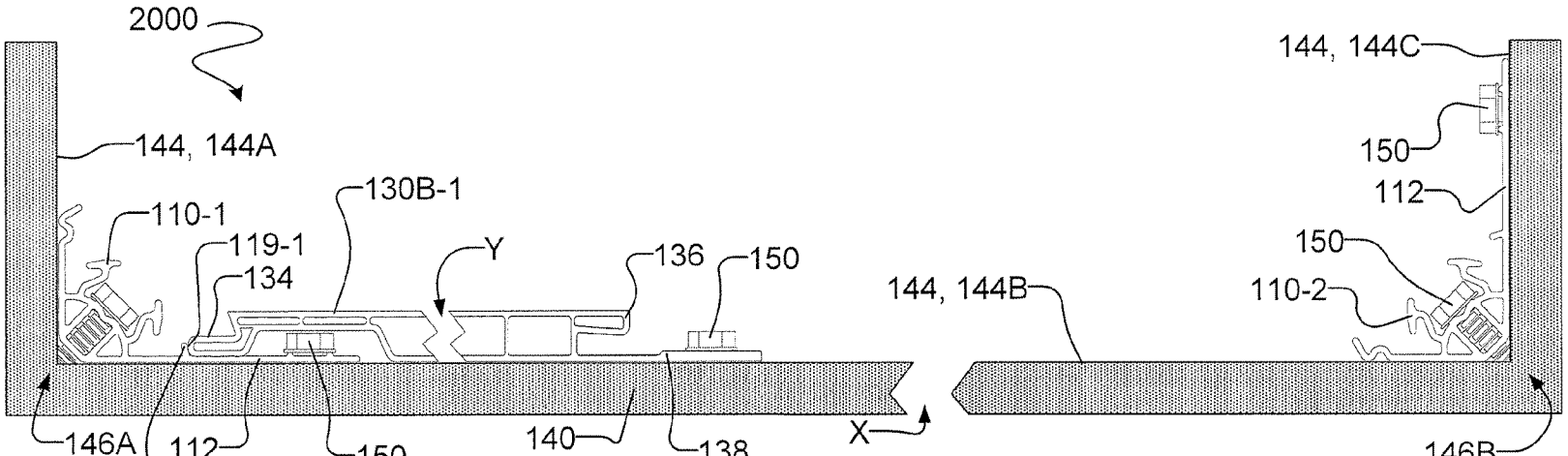
Figure 6C:
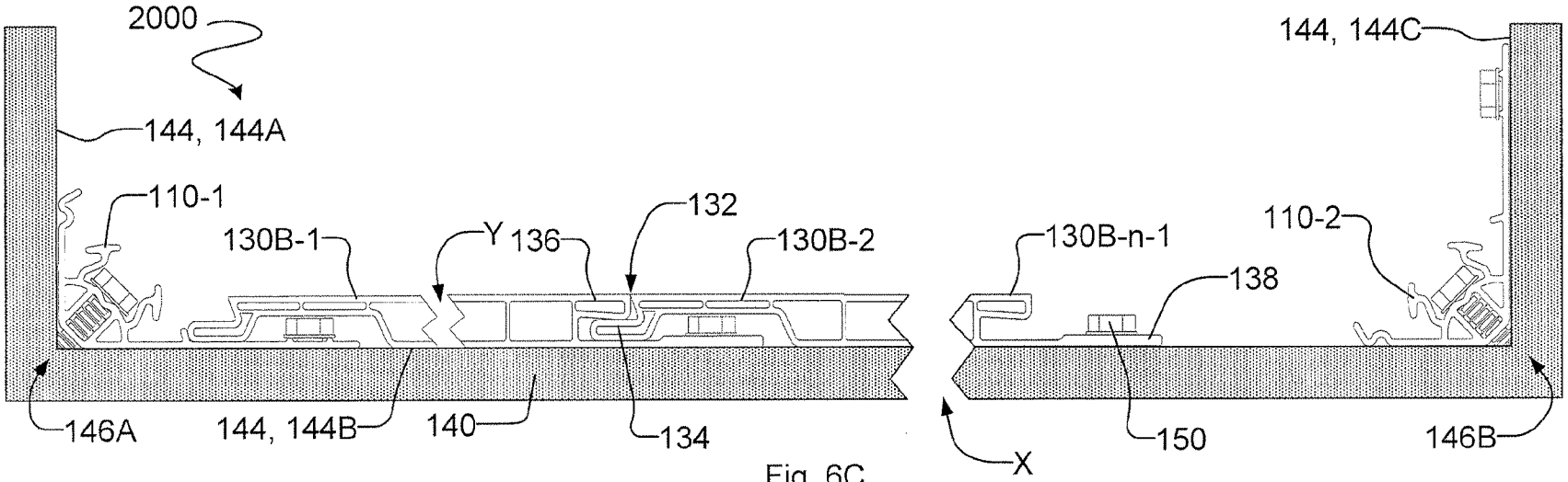
Figure 6D:
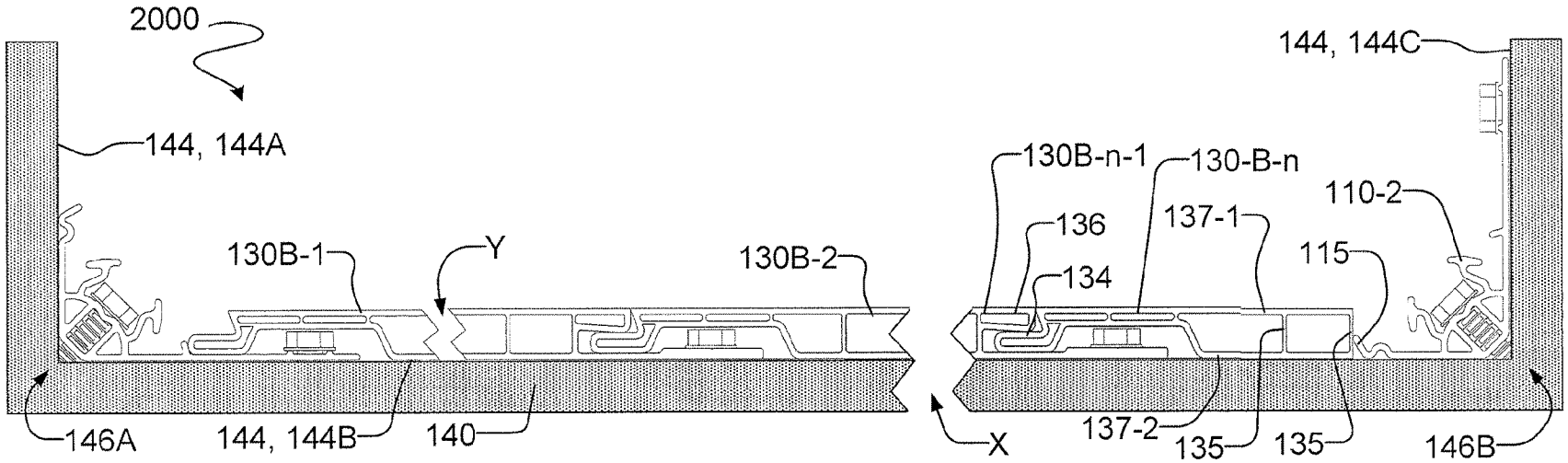
Figure 6E:
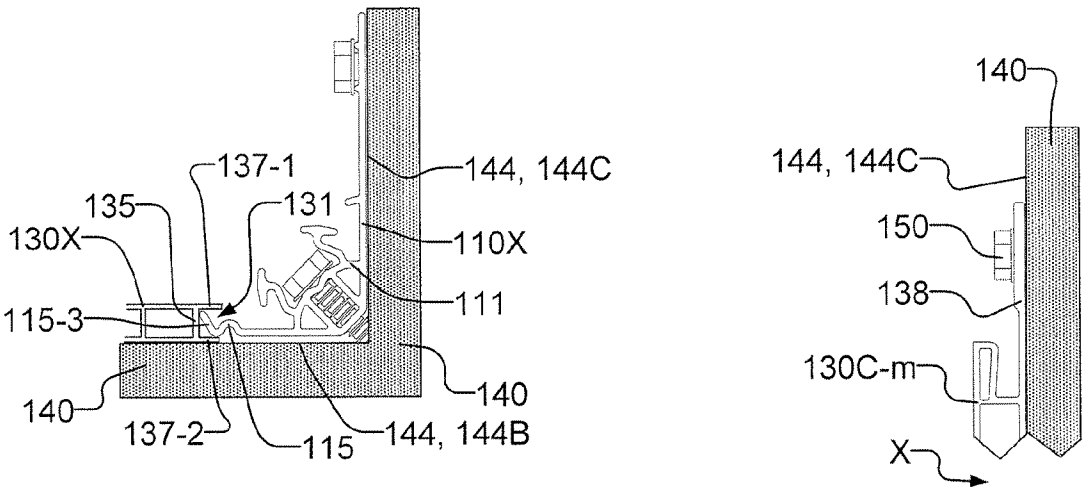
Figure 6F:
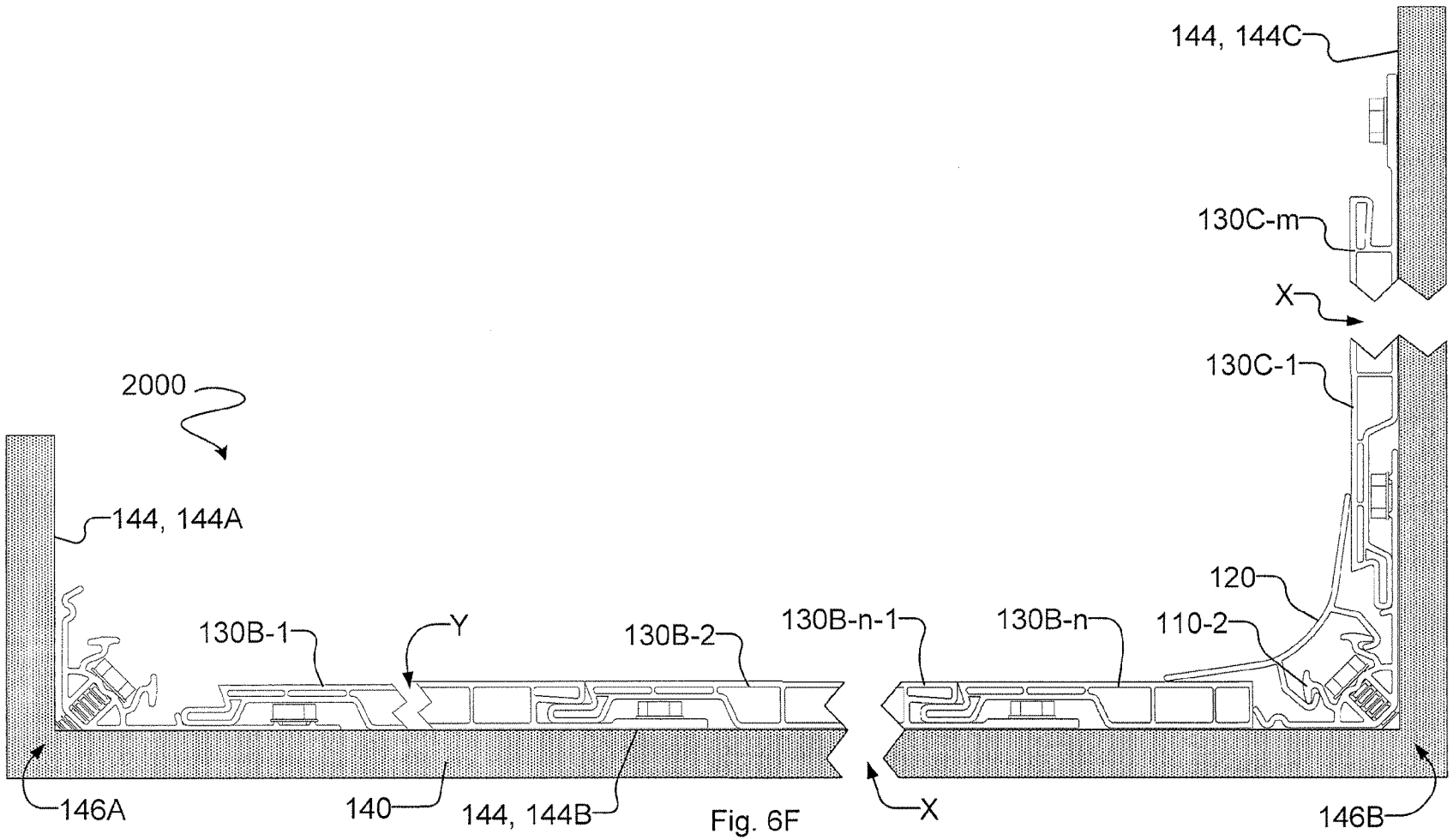

The illustrated portion of structure cladding 2000, as seen in FIG. 6F, has a first inside corner base piece 110-1 at corner 146A, a second inside corner base piece 110-2 at corner 146B, a plurality of panels 130B-1, 130B-2, . . . 130B-n-1, 130B-n along surface portion 144B, and a plurality of panels 130C-1, . . . 130C-m along surface portion 144C. These panels may be referred to herein as panels 130 where there is no need to distinguish individual panels.

Breaks X indicate that structure 140 may be of any suitable length and that any suitable number of panels 130 may extend along the surface portions 144B and 144C of structure 140. Break Y indicates that panels 130 may be of any suitable length.

Panels 130B-1, 130B-2, . . . 130B-n-1, 130B-n extend in longitudinal directions (i.e. into and out of the page in the views in FIGS. 6A-6F) and transverse directions along surface portion 144B of structure 140. Panels 130C-1, . . . 130C-m extend in longitudinal directions (i.e. into and out of the page in the views in FIGS. 6A-6F) and transverse directions along surface portion 144C of structure 140.

Structure 140 may comprise any suitable structure. Structure 140 may comprise drywall, gyprock, studs, concrete, furring strips, plywood, masonry, stucco, other wall layers, etc. Structure 140 may comprise the floor, ceiling, roof, exterior walls, interior walls, etc. of a structure. Structure 140 may comprise all of or a portion of a building, barn, silo, food storage container, car wash, factory, etc. Structure 140 may be rectilinear or curved. Where structure 140 is curved, panels 130 may be curved to match the curvature of structure 140. Additionally or alternatively, panels 130 may be deformable such that they can be deformed to match the curvature of structure 140.

Where surface 144 structure 140 has gaps (e.g. where surface 144 of structure 140 comprises transversely spaced apart studs or the like), one or more backing components may be attached between the studs to fill some portions of some gaps (e.g. the spaces between the studs) so that panels 130 or other components of a structure cladding (e.g. corner base pieces, repair strip base pieces) may be attached to the backing via fasteners 150.

Structure cladding 2000 of the illustrated embodiment is mounted to structure 140 by a plurality of fasteners 150. Fasteners 150 may comprise any suitable fasteners, including screws, nails, bolts, staples, etc. In some embodiments, structure cladding 2000 is mounted to structure 140 by other means, such as suitable adhesives and/or the like.

Each panel 130 comprises a male end 134 and a female end 136. Female end 136 comprises a mounting tab 138.

In FIG. 6A, base pieces 110-1 and 110-2 are attached to structure 140 by fasteners 150. In the illustrated embodiment, one set of fasteners 150 extend through central components 111 of base pieces 110-1, 110-2 and into structure 140 and another set of fasteners 150 extend through mounting tabs 112 of base pieces 110-1, 110-2 and into structure 140. It is not generally necessary to use both sets of fasteners 150. In some embodiments (e.g. where structure 140 is made of wood), the set of fasteners 150 that extend through central components 111 may be sufficient without using the set of fasteners 150 that extend through mounting tabs 112. In some embodiments (e.g. where structure 140 is made of concrete) the set of fasteners 150 that extend through mounting tabs 112 may be sufficient without using the set of fasteners 150 that extend through central components 111.

For every fastener 150 shown in FIGS. 6A-6F, there may be additional fasteners, not visible in the figures, spaced along the longitudinal dimension of structure cladding 2000 (i.e. into and out of the page and therefore not visible in FIGS. 6A-6F).

In FIG. 6B, panel 130B-1 is attached to structure 140 by fasteners 150 which extend through mounting tab 138. Male end 134 of panel 130B-1 covers the fasteners 150 that optionally pass through mounting tab 112 of base piece 110-1.

Nub 119 extends out of mounting tab 112. Nub 119 may provide a physical (e.g. tactile) indicator of the correct placement of panel 130B-1 relative to base piece 110-1. The male end 134 of panel 130B-1 may be slid across mounting tab 112 until it contacts nub 119, indicating that panel 130B-1 is correctly placed relative to base piece 110-1. Nub 119 has a bevelled edge 119-1. Bevelled edge 119-1 may be angled away from surface portion 144B of structure 140 as it extends toward corner 146A. This shape may tend to urge male end 134 of panel 130B-1 to deform slightly away from surface portion 144B of structure 140 when panel 130B-1 is forced or otherwise moves toward central component 111 of base piece 110-1. This interaction between panel 110B-1 and bevelled edge 119-1 of nub 119 may occur, for example, because of thermal expansion.

In FIG. 6C, the male end 134 of panel 130B-2 is inserted into the female end 136 of panel 130B-1. Panel 130B-2 is attached to structure 140 by fasteners 150 which extend through its mounting tab 138 in a manner similar to panel 130B-1 (although mounting tab 138 of panel 130B-2 is not visible in FIG. 6C). A small gap 132 may be left between panel 130B-1 and 130B-2 to accommodate thermal expansion of panels 130B-1 and 130B-2 (small gap 132 is too small to be visible in FIG. 6C). Similar small gaps may be left between other pairs of adjacent panels 130.

Panel 130B-n-1 is attached to structure 140 by fasteners 150 which extend through its mounting tab 138 in a manner similar to panel 130B-1.

In FIG. 6D, panel 130B-n is cut to fit between panel 130B-n-1 and deformation component 115 of base piece 110-2. Panel 130B-n has a cut end 139. Male end 134 of panel 130B-n is inserted into female end 136 of panel 130B-n-1 and cut end 139 of panel 130B-n may engage with deformation component 115. Deformation component 115 may deform to accommodate the insertion and/or thermal expansion of panel 130B-n, although such deformation is not necessary. When deformed, deformation component 115 may exert a restorative force against cut end 139 of panel 130B-n. The restorative force may assist in securing the engagement of male end 134 of panel 130B-n in female end 136 of panel 130B-n-1.

When panels 130B-1, 130B-2, . . . 130B-n-1, 130B-n experience thermal expansion (or contraction), deformation component 115 may deform so that it continues to engage cut end 139 of panel 130B-n and continues to exert a restorative force against cut end 139 of panel 130B-n.

In the illustrated embodiment, panels 130 are double walled panels with support braces 135 extending between wall 137-1 and wall 137-2. In FIG. 6D, panel 130B-n has been cut immediately adjacent to a brace 135.

Figure 7:
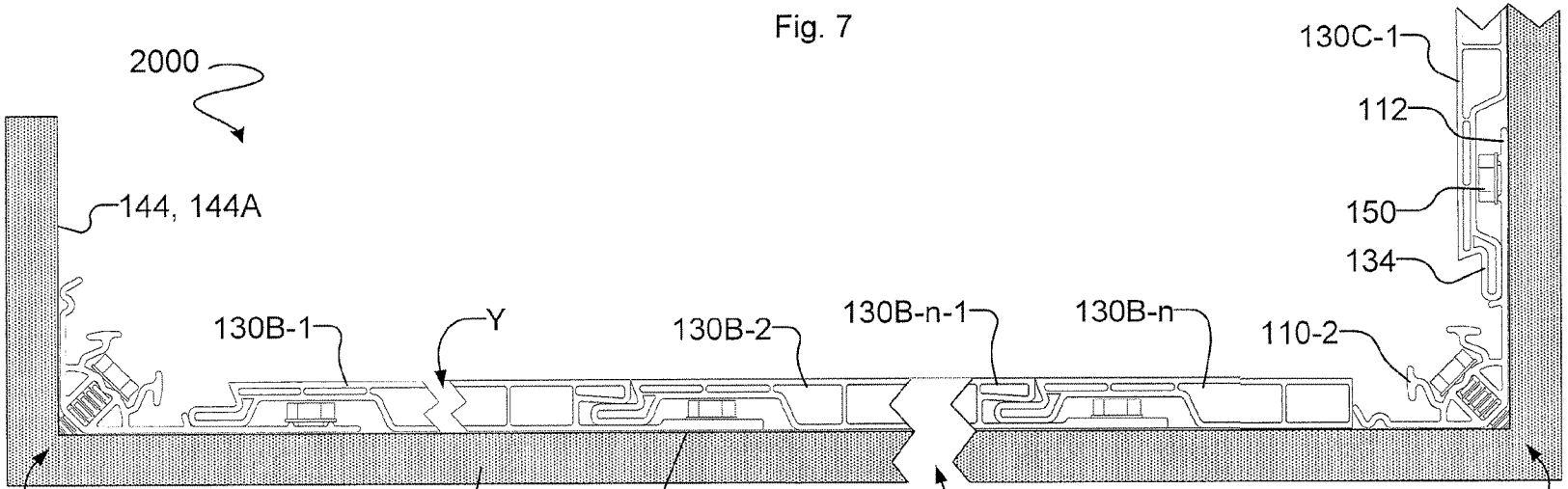
FIG. 7 is a top cross-sectional view of a cut end of a panel engaging a deformation component of an inside corner base piece according to a particular embodiment.

FIG. 7 shows a portion of a panel 130X with a cut end 139 that has been cut between two braces 135. Deformation component 115 of base piece 110X may extend into a concavity 131 defined on three sides by wall 137-1, brace 135, and wall 137-2, respectively. Wall 137-1 and wall 137-2 may restrain deformation component 115 (or at least a portion thereof) within concavity 131. As discussed above, the tip 115-3 of deformation component 115 may be bevelled to extend away from surface portion 144B of structure 140 as it extends away from central component 111 of base piece 110X. During thermal expansion and/or installation of panel 130X, this bevel angle of tip 115-3 tends to guide wall 137-2 toward surface portion 144B of structure 140 and to guide deformation component into concavity 131.

In FIG. 6E, panel 130C-1 is attached to surface portion 144C next to base piece 110-2 in the same way that panel 130B-1 was attached to surface portion 144B next to base piece 110-1. Further panels 130C (up to panel 130C-m) are attached to surface portion 144C of structure 140 by fasteners 150 which extend through its mounting tab 138 in a manner similar to panel 130C-1.

In FIG. 6F, trim piece 120 is connected to base piece 110-2 using the technique illustrated in FIGS. 8A and 8B.

FIG. 8A is a top cross-sectional view of corner 146B showing trim piece 120, base piece 110-2, panel 130B-n, and panel 130C-1. In FIG. 8A, trim piece 120 is brought into proximity of base piece 110-2, but is not yet connected to base piece 110-2.

In FIG. 8A, for the sake of clarity, the features of only one of arms 127 and only one of arms 117 are labelled. In FIG. 8B, for the sake of clarity, the features of arms 127 and arms 117 are not labelled. The features of arms 127 and arms 117 in FIGS. 8A and 8B can be identified by reference to the corresponding features of FIGS. 4 and 5.

FIG. 8B is a top cross-sectional view of corner 146B illustrating how trim piece 120 connects to base piece 110-2. Once located and oriented relative to base piece 110-2, as shown in FIG. 8A, trim piece 120 may be connected to base piece 110-2 by application of force (e.g. mallet blows) against trim piece 120 toward base piece 110-2 in direction B.

As trim piece 120 is forced in direction B, bevelled surfaces 128-3 of hooked portions 128 contact bevelled surfaces 118-3 of hooked portions 118. The relative angles of bevelled surfaces 128-3 and beveled surfaces 118-3 (as discussed above) are shaped such that forcing trim piece 120 in direction B causes arms 127 to deform away from each other and/or arms 117 to deform toward each other. As trim piece 120 is forced further in direction B, arms 127 pass arms 117, so that arms 117 extend between arms 127. For this reason, connector 124 may be referred to as a "female connector" and connector 114 may be referred to as a "male connector". In other embodiments, trim piece 120 comprises a male connector and base piece 110 comprises a female connector.

When trim piece 120 is forced sufficiently far in direction B, hook protrusions 128-1 of trim piece 120 pass hook protrusions 118-1 of base piece 110-2. From this configuration, moving trim piece 120 in a direction opposed to direction B causes hook protrusions 128-1 to extend into hook concavities 118-2 and hook protrusions 118-1 to extend into hook concavities 128-2. Movement of trim piece 120 in the direction opposed to direction B may be caused by restorative forces associated with deformation of connectors 114, 124 and/or wings 122. The engagement of hook protrusions 128-1 and hook protrusions 118-1 with hook concavities 118-2 and hook concavities 128-2, respectively, locks trim piece 120 to base piece 110-2 and prevents trim piece 120 from becoming unconnected from base piece 110-2.

In its unconnected state, wings 122 of trim piece 120 form an angle $\Theta$, as shown in FIG. 8A. Movement of trim 120 piece toward base piece 110-2 in direction B causes contact between wings 122 and panels 130B-n and 130C-1, respectively, on either side of base piece 110-2. Continued application of force in direction B causes wings 122 to deform toward one another to reduce angle $\Theta$ to angle $\Delta$ (where $\Delta<\Theta$), as shown in FIG. 8B. This deformation of wings 122 creates restorative (elastic) forces which tend to try to restore wings 122 to their undeformed state and thereby apply corresponding restorative forces against panels 130B-n and 130C-1, respectively. These restorative forces may force trim piece 120 in the direction opposed to direction B and may therefore cause hook protrusions 128-1, 118-1 to extend into hook concavities 118-2, 128-2, as discussed above.

Base piece 110 may be used on a corner of greater than or less than 90 degrees. In some embodiments, mounting tab 112 and extending tab 113 can be deformed toward each other (i.e. so that they form an angle of less than 90 degrees) or away from one another (i.e. so that they form an angle of more than 90 degrees) to form any angle between 80 degrees and 110 degrees. In some embodiments, both mounting tab 112 and extending tab 113 may be attached by fasteners 150 to structure 140; this may be particularly desirable where base piece 110 is used on a corner of greater than 90 degrees. In some embodiments, the angle formed between mounting tab 112 and extending tab 113 (in their undeformed positions) may be any angle between 30 and 150 degrees to facilitate use with a correspondingly wide variety of corner shapes.

Figure 9:
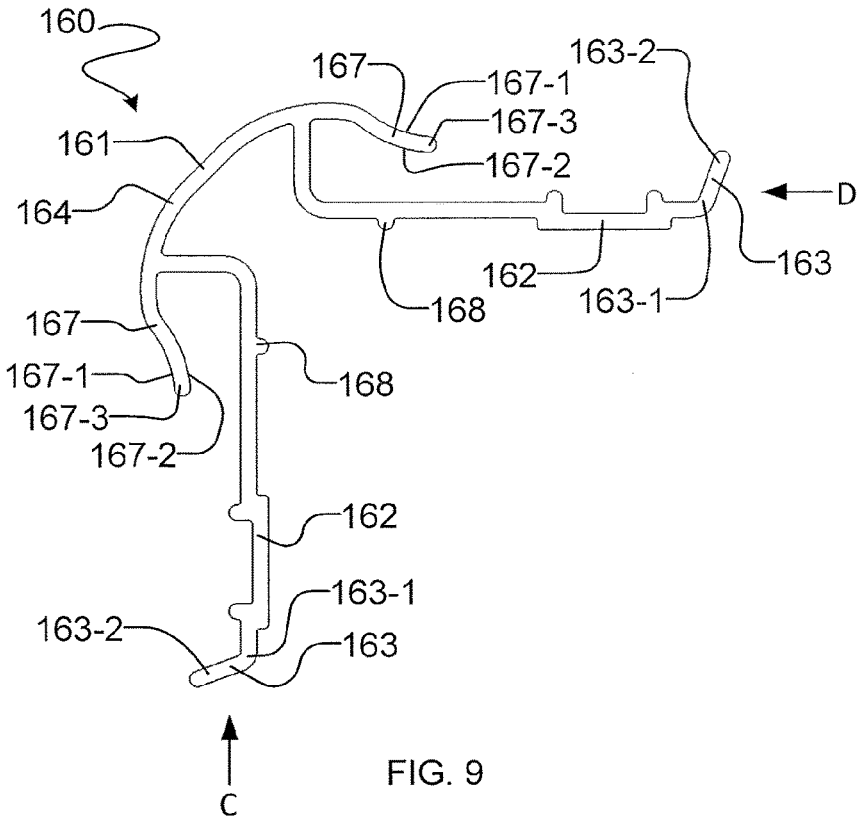
FIG. 9 is a top cross-sectional view of an outside corner base piece of a structure cladding according to a particular embodiment.

FIG. 9 is a top cross-sectional view of an outside corner base piece 160 which may be used in a structure cladding according to a particular embodiment. Base piece 160 of the illustrated embodiment is suitable for use on an "outside corner" of a structure to be cladded (e.g. a corner where the surface portions to be cladded form a corner of approximately 270 degrees), although it will be appreciated from the following description that base piece 160 may be used on outside corners which are not precisely 270 degrees by suitable deformation of base piece 160. Additionally or alternatively, base pieces similar to base piece 160 could be designed for other corner angles.

Base piece 160 comprises a central component 161 supporting mounting tabs 162 extending from central component 161. Mounting tabs 162 may comprise nubs 168. Nubs 168 may extend away from mounting tabs 162 toward surface portions 144D and 144E, respectively, of the structure 140 to be cladded (see FIG. 11A). Nubs 168 may space mounting tabs 162 away from the structure 140 to be cladded. Spacing mounting tabs 162 away from structure 140 may be desirable when the surface 144 of the structure 140 to be cladded is bumpy or uneven. Nubs 168 may also provide "fulcrums" around which mounting tabs 162 of base piece 160 may deform, as discussed in greater detail below.

Mounting tabs 162 of the illustrated embodiment comprise deformation components 163 at ends distal from central component 161. Deformation components 163 may be shaped such that when forces are applied against deformation components 163 in directions C and D, respectively, deformation components 163 may contract in directions C and D, respectively, and exert restorative forces opposed to directions C and D, respectively.

Deformation components 163 of the illustrated embodiment comprise the "hockey stick" shapes shown in FIG. 9. Each deformation component 163 may comprise a base 163-1 and an arm 163-2. When forces are applied against deformation components 163 in directions C and D, respectively, the angle formed at base 163-1 between arm 163-2 and mounting tab 162 may decrease so that the overall length of deformation components 163 in directions C and D, respectively, decreases. Deformation components 163 may comprise other shapes (e.g. the "zig zag" shape of deformation component 115, as discussed above), structures, and materials. For example, in some embodiments, deformation components 163 may comprise an elastomeric material that is different from the other portions of base piece 160.

Arms 163-2 of deformation components 163 may be bevelled to extend away from surface portions 144D and 144E, respectively, of the structure 140 to be cladded (see FIG. 11A)) as they extend transversely (i.e. away from central component 161). This bevelled shape of arms 163-2 allows deformation components 163 to guide a cut end of a panel toward surfaces 144D and 144E, respectively, of a structure 140 to be cladded (see FIG. 11A) in a manner similar to that of tip 115-3 of deformation component 115, as discussed above and as illustrated in FIG. 7 (e.g. during thermal expansion and/or installation).

Outside corner base piece 160 comprises a connector 164 for connecting to a complementary connector of an inside corner trim piece 170, as explained below. Connector 164 of the illustrated embodiment comprises a plurality (e.g. two) of arms 167 extending away from central portion 161. Arms 167 comprise outer surfaces 167-1, inner surfaces 167-2, and ends 167-3.

Figure 10:
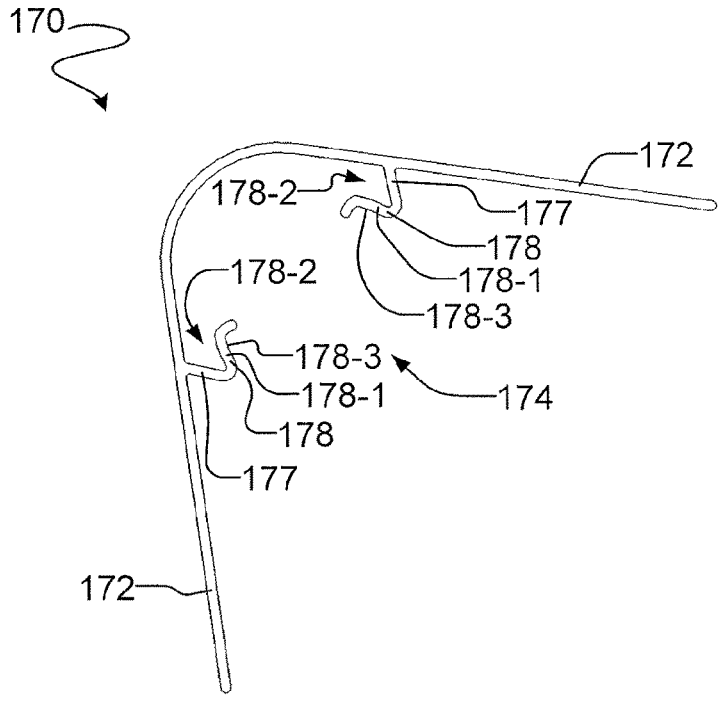
FIG. 10 is a top cross-sectional view of an outside corner trim piece of a structure cladding which may be used together with the FIG. 9 outside corner base piece according to a particular embodiment.
Figure 11A:
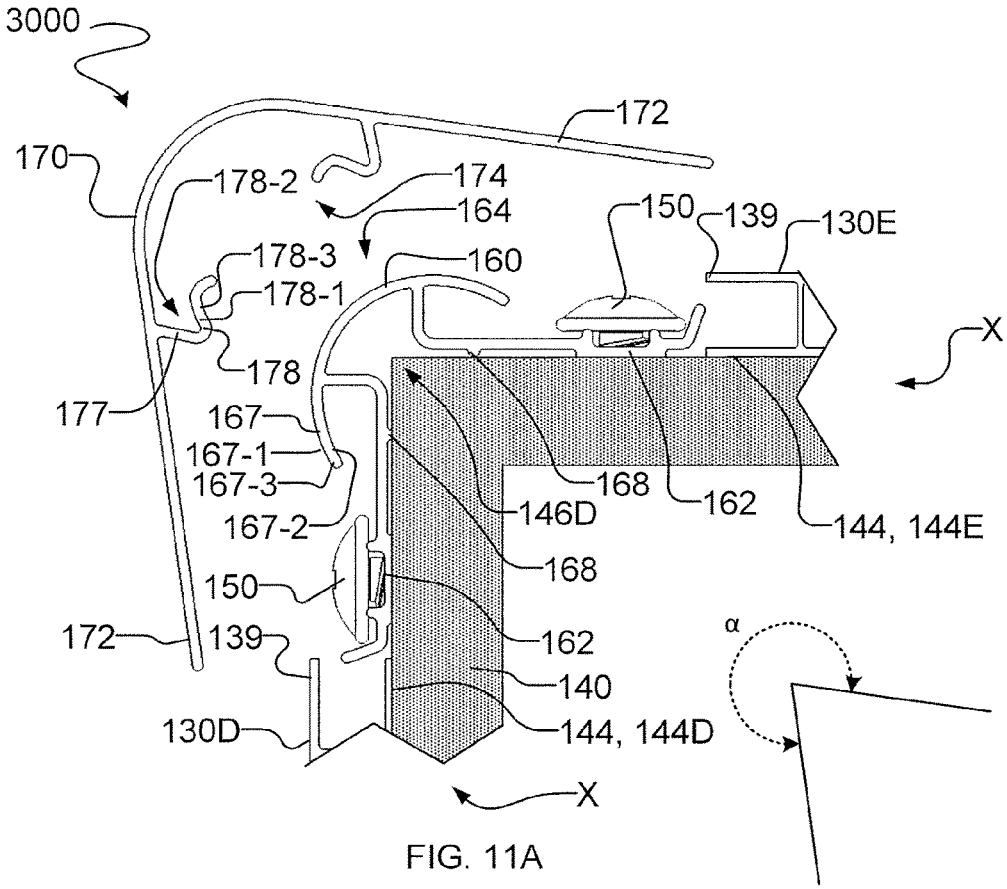
FIGS. 11A and 11B are top cross-sectional views illustrating the FIG. 10 outside corner trim piece connecting to the FIG. 9 outside corner base piece according to a particular embodiment.
Figure 11B:
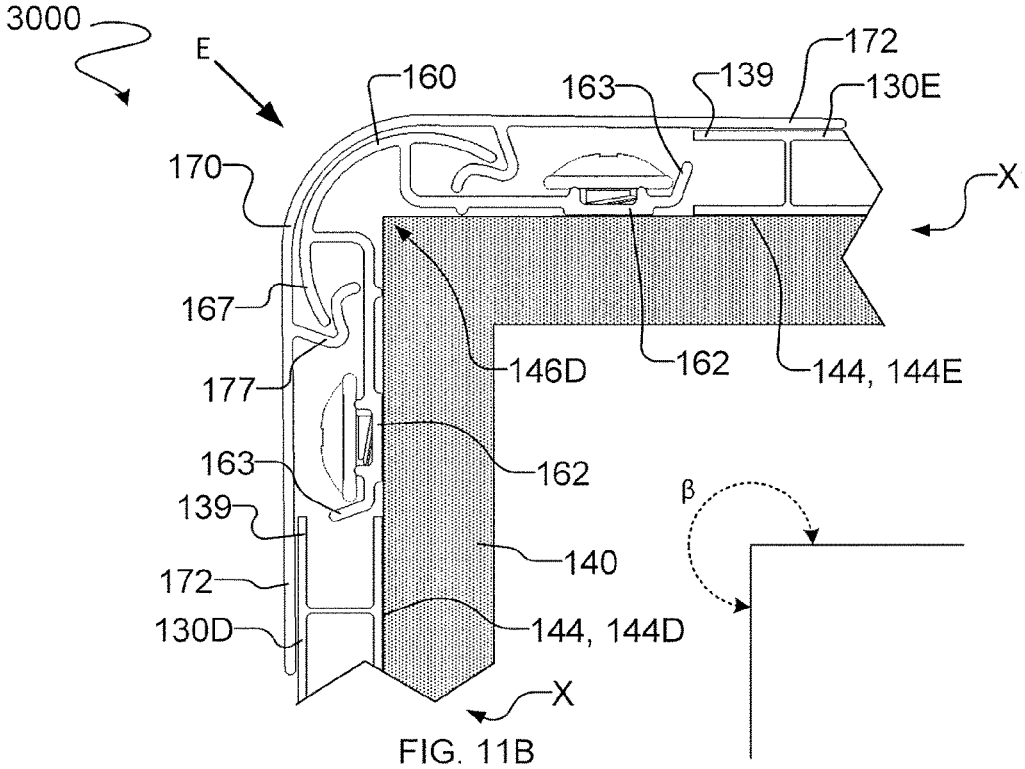

FIG. 10 is a top cross-sectional view of an outside corner trim piece 170 of a structure cladding according to a particular embodiment. FIGS. 11A and 11B are top cross-sectional views of outside corner trim piece 170 in use. Trim piece 170 comprises two transversely extending wings 172. Trim piece 170 also comprises a connector 174 for connecting to complementary connector 164 of base piece 160. Connector 174 of the illustrated embodiment comprises a plurality (e.g. two) of arms 177. In the illustrated embodiment, each of arms 177 comprises a hooked portion 178. Hooked portions 178 comprise hook protrusions 178-1 that define hook concavities 178-2. Hook concavities 178-2 open toward wings 172, respectively (i.e. away from surface portions 144D and 144E, respectively, of structure 140 to be cladded (see FIG. 11A)). Hook protrusions 178-1 define curved surfaces 178-3 which, in the illustrated embodiment, extend toward one another as they extend away from surface portions 144D and 144E, respectively, of structure 140 to be cladded (see FIG. 11A). In some embodiments, curved surfaces 178-3 may be replaced by bevelled surfaces.

FIG. 11A is a top cross-sectional view of a portion of a structure cladding 3000 cladding a portion of a surface 144 of a structure 140. Surface 144 comprises surface portions 144D and 144E which meet at corner 146D. Structure cladding 3000 comprises an outside corner base piece 160, an outside corner trim piece 170, and panels 130D and 130E. Breaks X indicate that structure 140 may be of any suitable size and that any suitable number of panels 130 may extend along the surface portions 144D and 144E of structure 140.

In FIG. 11A, for the sake of clarity, the features of only one of arms 177 and only one of arms 167 are labelled. In FIG. 11B, for the sake of clarity, the features of arms 177 and 167 are not labelled. The features of arms 177 and arms 167 in FIGS. 11A and 11B can be identified by reference to the corresponding features of FIGS. 9 and 10.

Outside corner base piece 160 is attached to a structure 140 by fasteners 150 which extend through mounting tabs 162. For every fastener 150 shown in FIGS. 11A and 11B, there may be additional fasteners not visible in the figures, spaced along the longitudinal dimension of structure cladding 3000 (i.e. into and out of the page and therefore not visible in FIGS. 11A and 11B).

FIG. 11B is a top cross-sectional view of corner 146D illustrating how trim piece 170 connects to base piece 160. Once located and oriented relative to base piece 160 as shown in FIG. 11A, trim piece 170 may be connected to base piece 160 by application of force (e.g. mallet blows) against trim piece 170 toward base piece 160 in direction E.

As trim piece 170 is forced in direction E, curved surfaces 178-3 of hooked portions 178 contact outer surfaces 167-1 of arms 167. The relative orientations of curved surfaces 178-3 and outer surfaces 167-1 (as discussed above) are such that forcing trim piece 170 in direction E causes arms 177 to deform away from each other and/or arms 167 to deform toward each other. As trim piece 170 is pushed further in direction E, arms 177 pass arms 167, so that arms 167 extend between arms 177. For this reason, connector 174 may be referred to as a "female connector" and connector 164 may be referred to as a "male connector". In other embodiments trim piece 170 comprises a male connector and base piece 160 comprises a female connector.

When trim piece 170 is forced sufficiently far in direction E, hook protrusions 178-1 of arms 177 pass ends 167-3 of arms 167. From this configuration, moving trim piece 170 in a direction opposed to direction E causes ends 167-3 to extend into hook concavities 178-2. Movement of trim piece 170 in the direction opposed to direction E may be caused by restorative forces associated with deformation of connectors 164, 174 and/or wings 172. The engagement of ends 167-2 with hook concavities 178-2 locks trim piece 170 to base piece 160 and prevents trim piece 170 from becoming unconnected from base piece 160.

In its unconnected state, wings 172 of trim piece 170 form an angle $\alpha$, as seen in FIG. 11A. Movement of trim piece 170 toward base piece 160 in direction E causes contact between wings 172 and panels 130D and 130E, respectively, on either side of base piece 160. Continued application of force in direction E causes wings 172 to deform toward one another to reduce angle $\beta$ to angle $\beta$ (where $\beta<\alpha$), as seen in FIG. 11B. This deformation of wings 172 creates restorative (elastic) forces which tend to try to restore wings 127 to their undeformed state and thereby apply corresponding restorative forces against panels 130, respectively. These restorative forces may force trim piece 170 in the direction opposed to direction E and may therefore cause ends 167-3 to extend into hook concavities 178-2, as discussed above.

Base piece 160 may be used on a corner of greater than or less than 270 degrees. In some embodiments, mounting tabs 162 can be deformed toward each other (i.e. so that they form an angle of more than 270 degrees) or away from one another (i.e. so that they form an angle of less than 270 degrees) to form any angle between 260 degrees and 280 degrees. In some embodiments, mounting tabs 162 may deform about the "fulcrums" provided by numbs 168. In some embodiments, the angle formed between mounting tabs 162 (in their undeformed positions) may be any angle between 210 and 330 degrees.

In the embodiment illustrated in FIG. 11B, wings 172 contact cut ends 139 of panels 130D and 130E, respectively. In some embodiments, wings 172 may contact any combination of cut ends 139, male ends 134, and female ends 136 of panels 130.

In some embodiments, deformation components 163 may contact panels 130D and 130E in a similar way to the contact between deformation component 115 and panel 130X, as described above and as illustrated in FIG. 7.

Figure 12:
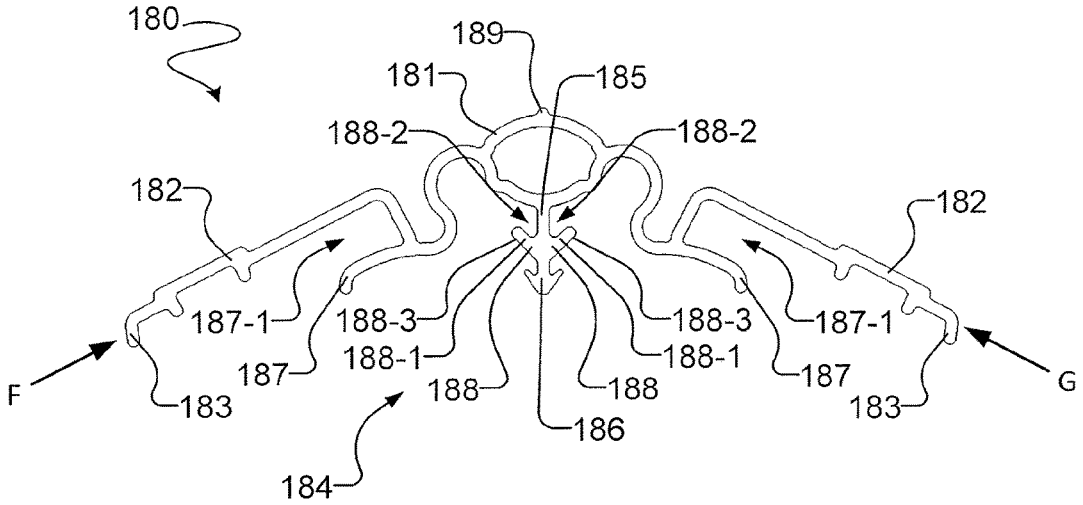
FIG. 12 is a top cross-sectional view of an obtuse corner base piece of a structure cladding according to a particular embodiment.

FIG. 12 is a top cross-sectional view of an obtuse corner base piece 180 which may be used in a structure cladding according to a particular embodiment. Base piece 180 of the illustrated embodiment is suitable for use on an "obtuse corner" of a structure to be cladded. In the illustrated embodiment, obtuse corner base piece 180 is suitable for use on a corner of 115 degrees, although it will be appreciated from the following description that base piece 180 may be used on outside corners which are not precisely 115 degrees by suitable deformation of base piece 180. Additionally or alternatively, base pieces similar to base piece 180 could be designed to have non-deformed angles suitable for use with other obtuse corner angles.

Base piece 180 comprises a central component 181 supporting mounting tabs 182 which extend from central component 181. Mounting tabs 182 comprise deformation components 183 at ends distal from central component 181. Deformation components 183 may be shaped such that when forces are applied against deformation components 183 in directions F and G, respectively, deformation components 183 contract in directions F and G, respectively and exert restorative force opposed to directions F and G, respectively.

Deformation components 183 may function similarly to deformation components 163, as described above.

Obtuse corner base piece 180 comprises a connector 184 for connecting to a complementary connector of an obtuse corner trim piece 190, as explained below. Connector 184 of the illustrated embodiment may comprise a stem 185 extending from central component 181. Stem 185 comprises a guiding arrow 186 located at the end of stem 185 distal from central component 181. Guiding arrow 186 is shown in greater detail in FIG. 12A.

Figure 12A:
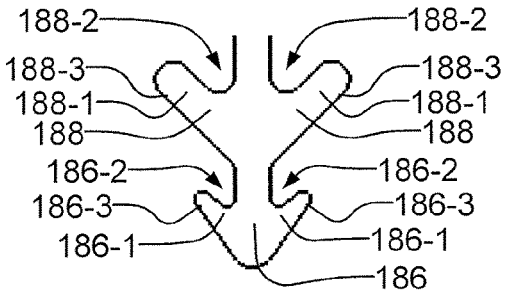
FIG. 12A is a close up view of a portion of the FIG. 12 obtuse corner base piece.

As shown in FIG. 12A, guiding arrow 186 comprises arrow protrusions 186-1 that define arrow concavities 186-2. Arrow concavities 186-2 open toward central component 181 (i.e. toward surface portions 144F and 144G, respectively, of structure 140 to be cladded (see FIG. 14A)). Arrow protrusions 186-1 define bevelled surfaces 186-3 which, in the illustrated embodiment, extend away from one another as they extend toward surface portions 144F and 144G, respectively, of structure 140 to be cladded (see FIG. 14A).

Stem 185 comprises barbs 188. Barbs 188 comprise barb protrusions 188-1 that define barb concavities 188-2. Barb concavities 188-2 open toward central component 181 (i.e. toward surface portions 144F and 144G, respectively, of structure 140 to be cladded (see FIG. 14A)). Barb protrusions 188-1 define bevelled surfaces 188-3 which, in the illustrated embodiment, extend away from one another as they extend toward surface portions 144F and 144G, respectively, of structure 140 to be cladded (see FIG. 14A).

Base piece 180 may comprise arms 187 that define receptacles 187-1.

Base piece 180 may comprise a nub 189 extending away from central component 181. Nub 189 may provide a physical (e.g. tactile) indicator of the correct placement of base piece 180 relative to a corner 146F of a structure 140 to be cladded (see FIG. 14A). Nub 189 is discussed in greater detail below.

Figure 13:
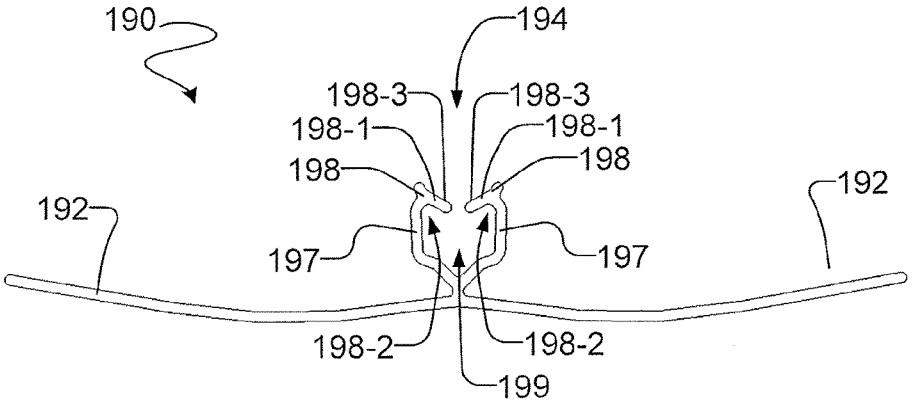
FIG. 13 is a top cross-sectional view of an obtuse corner trim piece of a structure cladding which may be used together with the FIG. 12 obtuse corner base piece according to a particular embodiment.
Figure 14A:
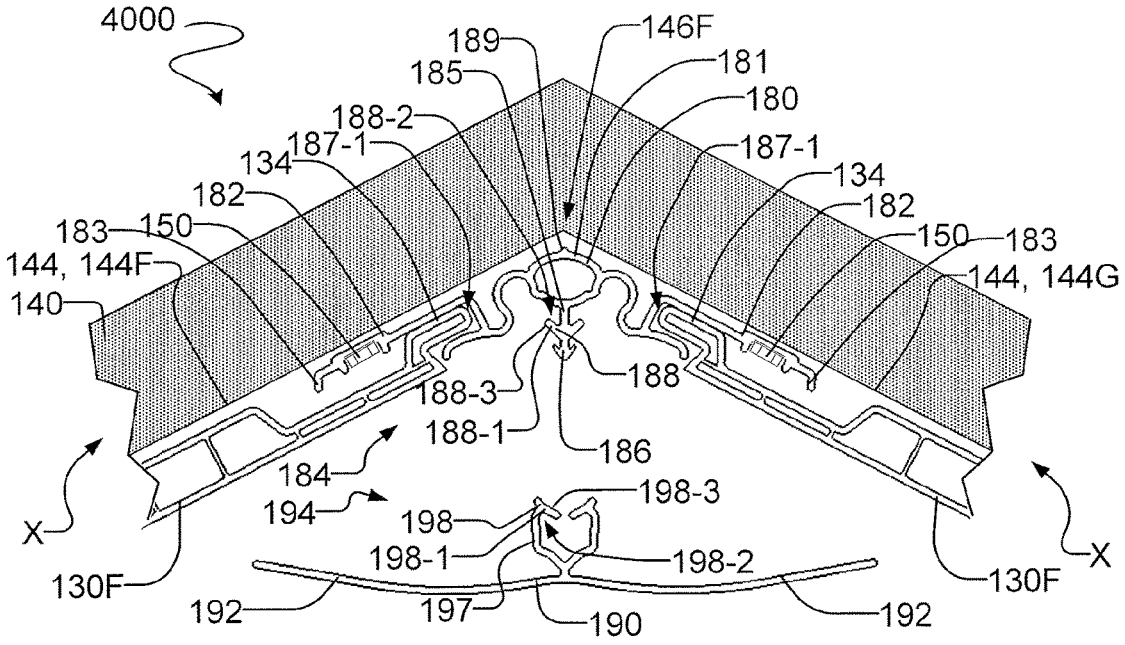
FIGS. 14A and 14B are top cross-sectional views illustrating the FIG. 13 obtuse corner trim piece connecting to the FIG. 12 obtuse corner base piece according to a particular embodiment.
Figure 14B:
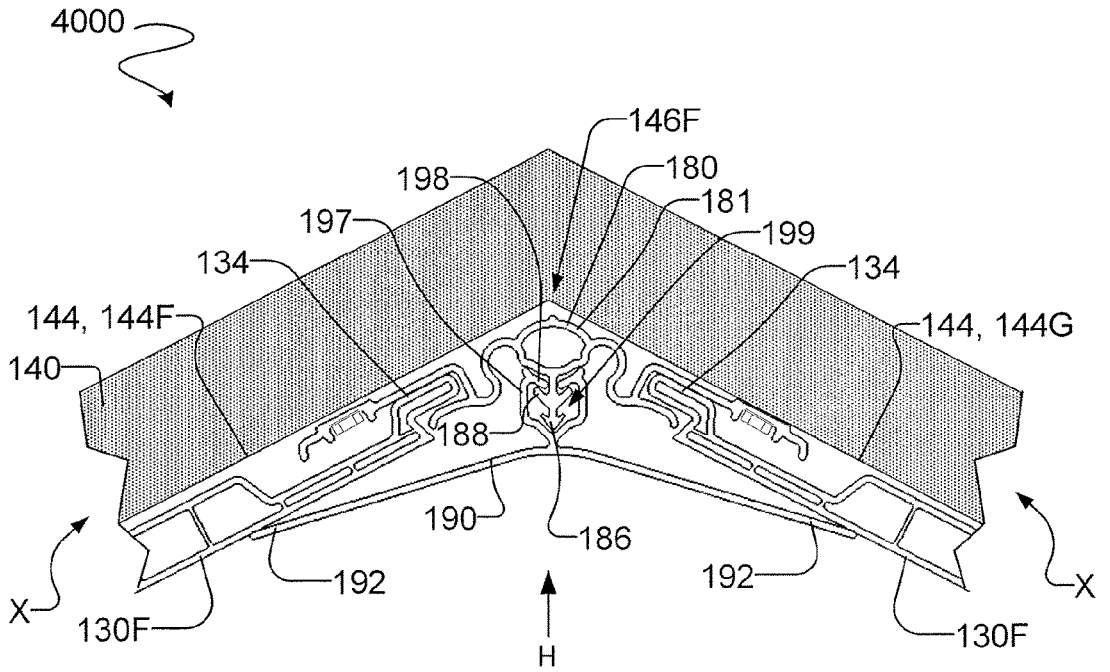

FIG. 13 is a top cross-sectional view of an obtuse corner trim piece 190 of a structure cladding according to a particular embodiment. FIGS. 14A and 14B are top cross-sectional views of outside corner trim piece 190 in use. Trim piece 190 comprises two transversely extending wings 192. Trim piece 190 also comprises a connector 194 for connecting to complementary connector 184 of base piece 180. Connector 194 of the illustrated embodiment comprises a plurality (e.g. two) of arms 197. In the illustrated embodiment, each of arms 197 comprises a hooked portion 198. Hooked portions 198 comprise hook protrusions 198-1 that define hook concavities 198-2. Hook concavities 198-2 open toward wings 192, respectively (i.e. away from surface portions 144F and 144G, respectively, of structure 140 to be cladded (see FIG. 14A)). Hook protrusions 198-1 define bevelled surfaces 198-3 which, in the illustrated embodiment, extend toward one another as they extend away from surfaces 144F and 144G, respectively, of structure 140 to be cladded (see FIG. 14A). Arms 197 and hooked portions 198 define a receptacle 199.

FIG. 14A is a top cross-sectional view of a portion of a structure cladding 4000 cladding a portion of a surface 144 of a structure 140. Surface 144 has surface portions 144F and 144G which meet at corner 144F. Structure cladding 4000 comprises an obtuse corner base piece 180, an obtuse corner trim piece 190, and panels 130F and 130G. Breaks X indicate that structure 140 may be of any suitable size and that any suitable number of panels 130 may extend along the surface portions 144F and 144G of structure 140. In FIG. 14A, trim piece 190 is brought into proximity of base piece 180, but is not yet connected to base piece 180.

In FIG. 14A, for the sake of clarity, the features of guiding arrow 186 are not labelled and the features of only one of arms 197 and only one of barbs 186 are labelled. In FIG. 14B, for the sake of clarity, the features of guiding arrow 186, arms 197, and barbs 186 are not labelled. The features of guiding arrow 186, arms 197, and barbs 186 in FIGS. 14A and 14B can be identified by reference to the corresponding features of FIGS. 12, 12A and 13.

In the illustrated embodiment, nub 189 does not touch corner 146F. In some embodiments, however, nub 189 may touch corner 146F. Contact between nub 189 and corner 146F may provide a physical (e.g. tactile) indicator of the correct placement of base piece 180 relative to structure 140.

Obtuse corner base piece 180 is attached to a structure 140 by fasteners 150 which extend through mounting tabs 182. For every fastener 150 shown in FIGS. 14A and 14B, there may be additional fasteners not visible in the figures, spaced along the longitudinal dimension of structure cladding 4000 (i.e. into and out of the page and therefore not visible in FIGS. 14A and 14B).

Male ends 134 of panels 130F and 130G are inserted into receptacles 187-1 of base piece 180. In some embodiments of the invention, cut off ends of panels 130 may be attached to surface portions 144F and 144G and may contact deformation components 183 in a similar way to the contact between deformation component 115 and panel 130X, as described above and as illustrated in FIG. 7.

FIG. 14B is a top cross-sectional view of corner 146F illustrating how trim piece 190 connects to base piece 180. Once located and oriented relative to base piece 168 as shown in FIG. 14A, trim piece 190 may be connected to base piece 180 by application of force against trim piece 190 toward base piece 180 in direction H.

As trim piece 190 is forced in direction H, bevelled surfaces 198-3 of arms 197 contact bevelled surfaces 186-3 of guiding arrow 186. The relative angles of bevelled surfaces 198-3 and bevelled surfaces 186-3 (as discussed above) are such that forcing trim piece 190 in direction H causes arms 197 to deform away from each other. As trim piece 190 is pushed further in direction H, arms 197 pass guiding arrow 186, so that guiding arrow 186 enters receptacle 199. For this reason, connector 194 may be referred to as a "female connector" and connector 184 may be referred to as a "male connector". In other embodiments trim piece 190 comprises a male connector and base piece 180 comprises a female connector.

When trim piece 190 is forced sufficiently far in direction H, hook protrusions 198-1 of trim piece 190 pass arrow protrusions 186-1 guiding arrow 186. From this configuration, moving trim piece 190 in a direction opposed to direction H causes arrow protrusions 186-1 to extend into hook concavities 198-2 and hook protrusions 198-1 to extend into arrow concavities 186-2. Movement of trim piece 190 in the direction opposed to direction H may be caused by gravity. The engagement of arrow protrusions 186-1 and hook protrusions 198-1 with hook concavities 198-2 and arrow concavities 186-2, respectively, holds trim piece 190 in place. This configuration between trim piece 190 and base piece 180 may be referred to as a "preliminary connection". The retention forces associated with this preliminary connection may be greater than the force of gravity on trim piece 190, such that a preliminary connection could be used to hold trim piece 190 in place (relative to base piece 180) if direction H was vertically upward. For example, in some embodiments, base piece 180 may be attached to a ceiling, and the preliminary connection may facilitate easy installation of trim piece 190 to base piece 180. In some embodiments, it may be possible to form the preliminary connection without using tools (e.g. using only bare hands and not a mallet).

As trim piece 190 is pushed still further in direction H (e.g. by mallet blows), bevelled surfaces 198-3 of arms 197 contact bevelled surfaces 188-3 of barbs 188. The relative angles of bevelled surfaces 198-3 and bevelled surfaces 188-3 (as discussed above) are such that forcing trim piece 190 in direction H causes arms 197 to deform away from each other. When trim piece 190 is forced sufficiently far in direction H, hook protrusions 198-1 of trim piece 190 pass barb protrusions 188-1 of barbs 188. From this configuration, moving trim piece 190 in a direction opposed to direction H causes barb protrusions 188-1 to extend into hook concavities 198-2 and hook protrusions 198-1 to extend into barb concavities 188-2. Movement of trim piece 190 in the direction opposed to direction H may be caused (in part) by restorative forces associated with deformation of connectors 194, 184 and/or wings 192. The engagement of barb protrusions 188-1 and hook protrusions 198-1 with hook concavities 198-2 and barb concavities 188-2, respectively, locks trim piece 190 to base piece 180 and prevents trim piece 190 from becoming unconnected from base piece 180.

Wings 192 of trim piece 190 may have structures and functions that are similar to the structures and functions of wings 172 of trim piece 170, as described above and as illustrated in FIGS. 11A and 11B.

Figure 15:
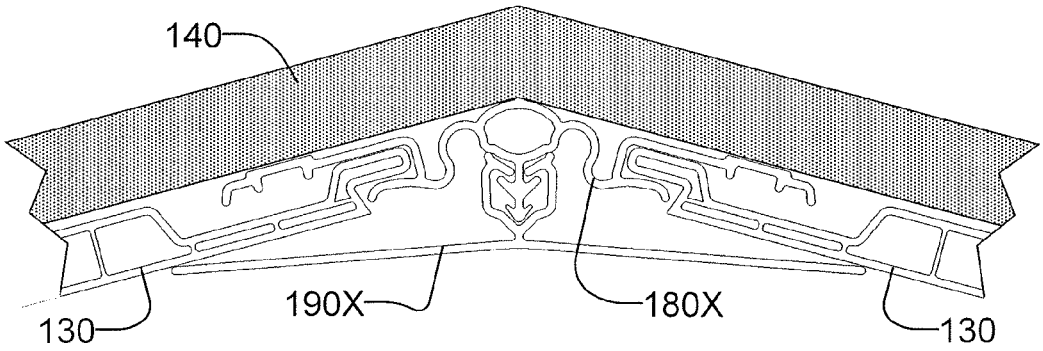
FIG. 15 is a top cross-sectional view of a modified version of the FIG. 12 obtuse corner base piece and the FIG. 13 obtuse corner trim piece for use in a corner having a different angle.

Base piece 180 may be used on a corner of greater than or less than 115 degrees. In some embodiments, mounting tabs 182 can be deformed toward each other (i.e. so that they form an angle of less than 115 degrees) or away from one another (i.e. so that they form an angle of greater than 115 degrees) to form any angle between 105 degrees and 125 degrees. In some embodiments, the angle formed between mounting tabs 182 (in their undeformed positions) may be any angle between 5 and 175 degrees. FIG. 15 shows an example embodiment of an obtuse corner base piece 180X and an obtuse corner trim piece 190X that are configured to be used on a 150 degree corner of structure 140. The mounting tabs 182 of base piece 180X form an angle of 150 degrees in their undeformed state.

One embodiment of the invention comprises methods and apparatus for repairing an existing structure cladding.

Figure 16:
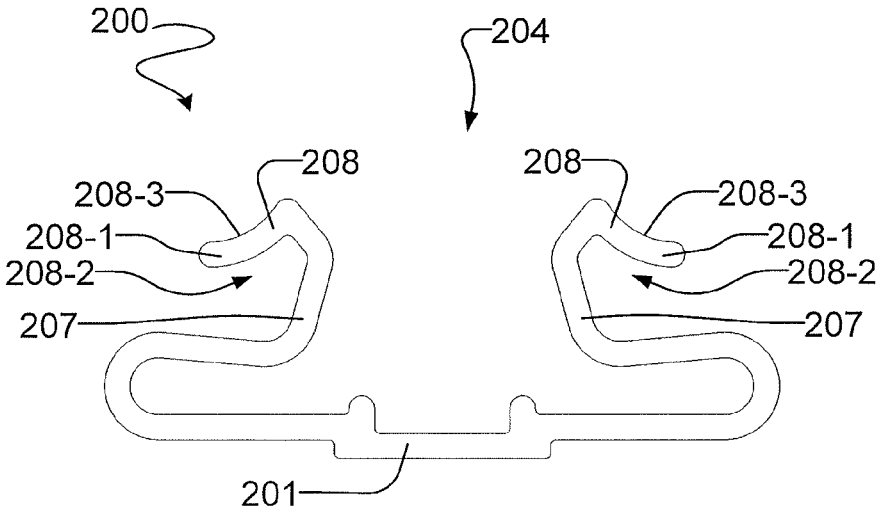
FIG. 16 is a top cross-sectional view of a repair strip base piece for a structure cladding according to a particular embodiment.

FIG. 16 is a top cross-sectional view of a repair strip base piece 200 according to a particular embodiment. Base piece 200 of the illustrated embodiment may be used to repair an existing structure cladding.

Base piece 200 comprises a central component 201. Base piece 200 also comprises a connector 204 for connecting to a complementary connector of a repair strip trim piece 210, as explained below. Connector 204 of the illustrated embodiment comprises a plurality (e.g. two) of arms 207. In the illustrated embodiment, each of arms 207 comprises a hooked portion 208. Hooked portions 208 comprise hook protrusions 208-1 that define hook concavities 208-2. Hook concavities 208-2 open toward central component 201 (i.e. toward the surface portion 144H of the cladded structure 140 (see FIG. 18E)). Hook protrusions 208-1 define surfaces 208-3 which, in the illustrated embodiment, extend away from one another as they extend toward surface portion 144H of the cladded structure 140 (see FIG. 18E).

In some embodiments repair strip 200 may have deformation components (not shown) on one or both sides of central component 201. These deformation components may be similar to deformation components 115 or 163, as described above.

Figure 17:
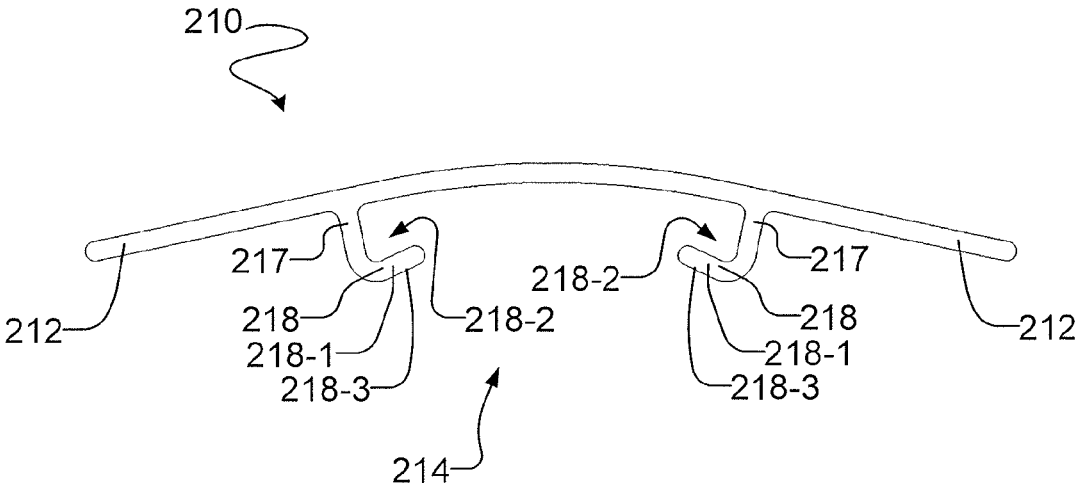
FIG. 17 is a top cross-sectional view of a repair strip trim piece for a structure cladding which may be used together with the FIG. 16 repair strip base piece according to a particular embodiment.

FIG. 17 is a top cross-sectional view of a repair strip trim piece 210 according to a particular embodiment. Trim piece 210 comprises two transversely extending wings 212. Trim piece 210 also comprises a connector 214 for connecting to complementary connector 204 of base piece 200. Connector 214 of the illustrated embodiment comprises a plurality (e.g. two) of arms 217. In the illustrated embodiment, each of arms 217 comprises a hooked portion 218. Hooked portions 218 comprise hook protrusions 218-1 that define hook concavities 218-2. Hook concavities 218-2 open toward wings 212 (i.e. away from surface portion 144H of cladded structure 140 (see FIG. 18E)). Hook protrusions 218-1 define bevelled surfaces 218-3 which, in the illustrated embodiment, extend toward one another as they extend away from surface portion 144H of cladded structure 144 (see FIG. 18E).

Figure 18A:
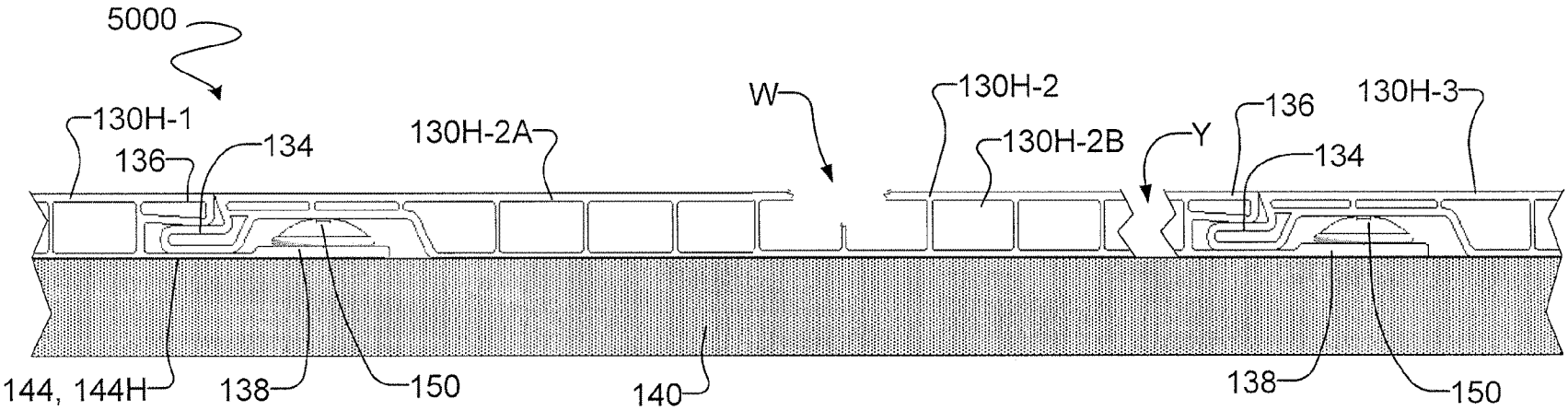
FIGS. 18A-18F are top cross-sectional views illustrating a number of steps involved in repairing a structure cladding using the FIG. 16 repair strip base piece and the FIG. 17 repair strip trim piece according to a particular embodiment.

FIGS. 18A-18F are top cross-sectional views illustrating a number of steps involved in repairing a portion of a structure cladding 5000 according to a particular embodiment. Structure cladding 5000 clads a portion of a surface portion 144H of a structure 140. The illustrated portion of structure cladding 5000 comprises panels 130H-1, 130H-2, and 130H-3. Panels 130H are mounted in a similar manner to panels 130B, as described above and as illustrated in FIGS. 6A-6D. In FIG. 18A, panel 130H-2 has a damaged portion W and needs to be replaced.

Figure 18B:
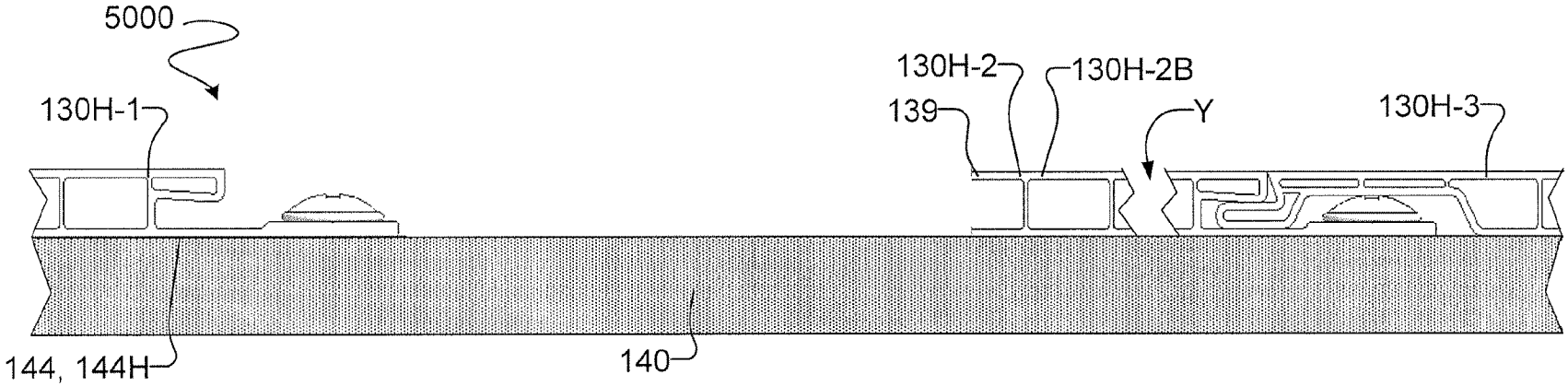

In FIG. 18B, panel 130H-2 is cut longitudinally (i.e. in the direction into and out of the page in the views in FIGS. 18A-18E) into a first piece 130H-2A (shown in FIG. 18B) including male end 134 and damaged portion W and a second piece 130H-2B including female end 136. First piece 130H-2A is removed. In some embodiments, first piece 130H-2A is removed by deforming first piece 130H-2A or by making one or more additional cuts in first piece 130H-2A.

Figure 18C:
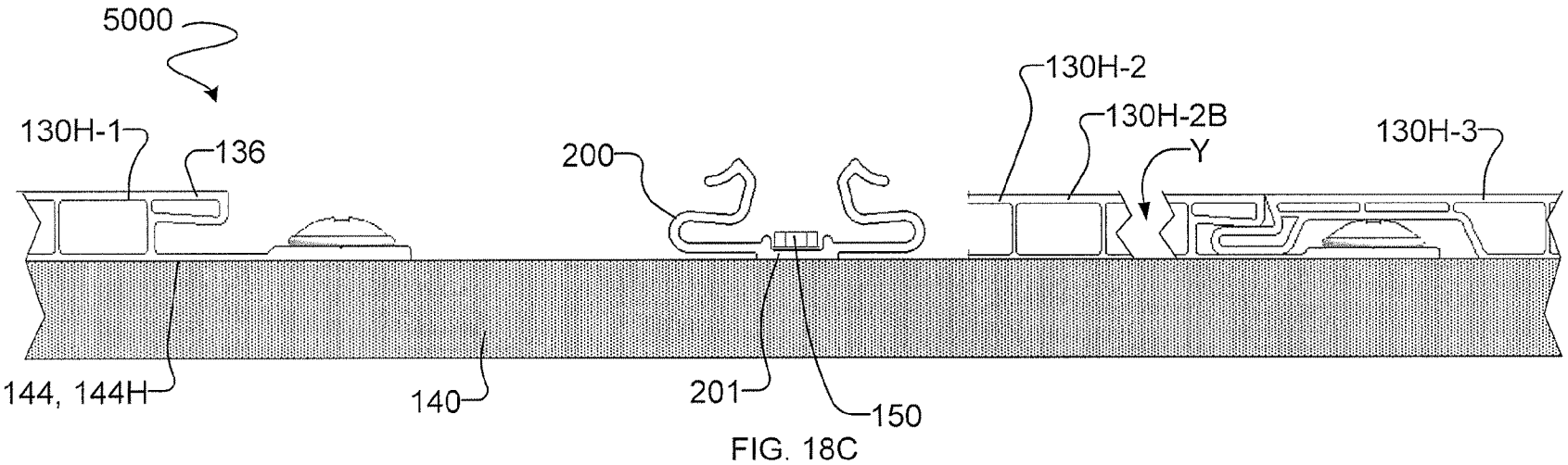

In FIG. 18C, repair strip 200 is mounted to surface portion 144H of structure 140 (adjacent remaining piece 130H-2B of panel 130H-2) by fasteners 150 which extend through central component 201. Typically, there will be a plurality of fasteners 50 spaced apart from one another along the longitudinal dimension of repair strip 200 (i.e. spaced along the dimension into and out of the page and therefore not visible in the views of FIGS. 18A-18F). In some embodiments of the invention, structure 140 may contain gaps. In such embodiments, backing component(s) (not shown) may be attached to structure 140 to fill a portion of a gap, and repair strip 200 may be attached to the backing component(s).

Figure 18D:
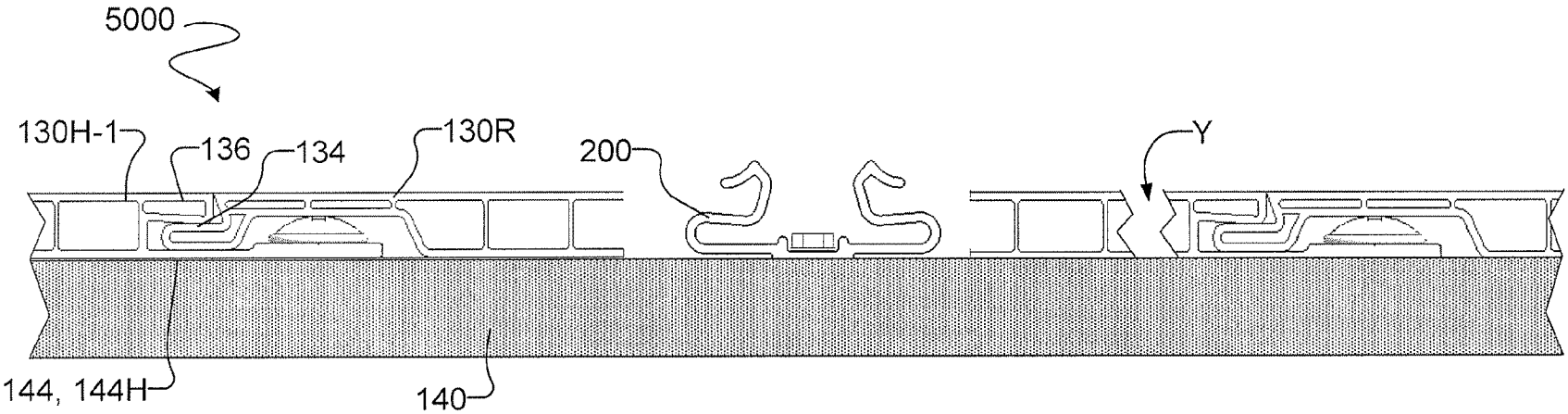

In FIG. 18D, the male end 134 of a replacement panel 130R is inserted into the female end 136 of panel 130H-1. Replacement panel 130R is cut to fit between panel 130H-1 and repair strip 200 (on a side opposite repair strip 200 from remaining piece 130H-2B of panel 130H-2). Depending on the size of damaged portion W, it may be possible to use part of first piece 130H-2A as the replacement panel 130R.

Figure 18E:
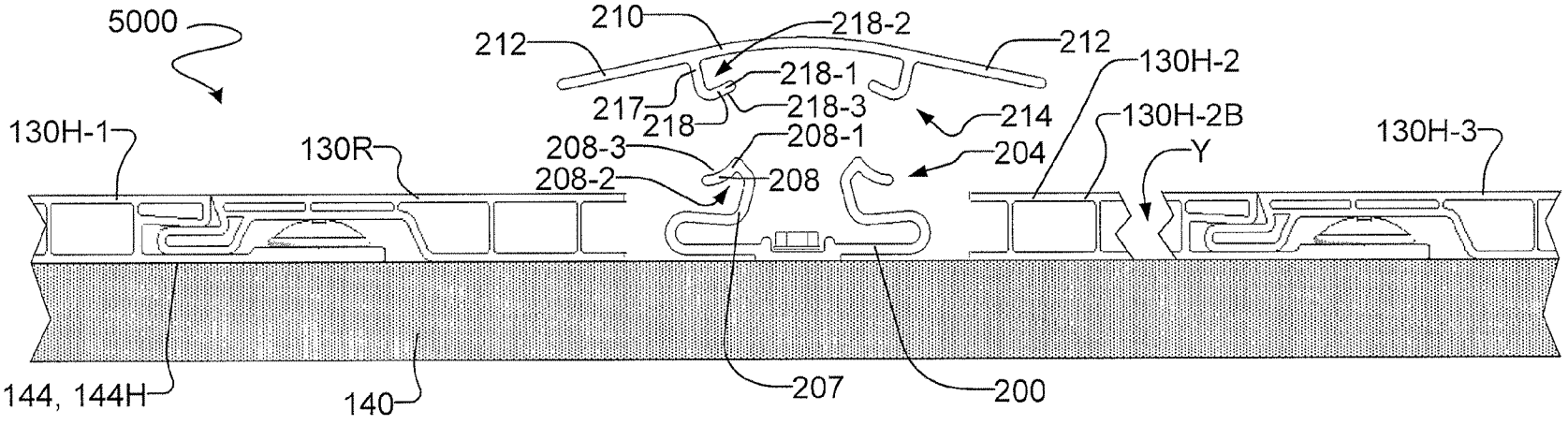

In FIG. 18E, trim piece 210 is located and oriented relative to base piece 200 as illustrated.

Figure 18F:
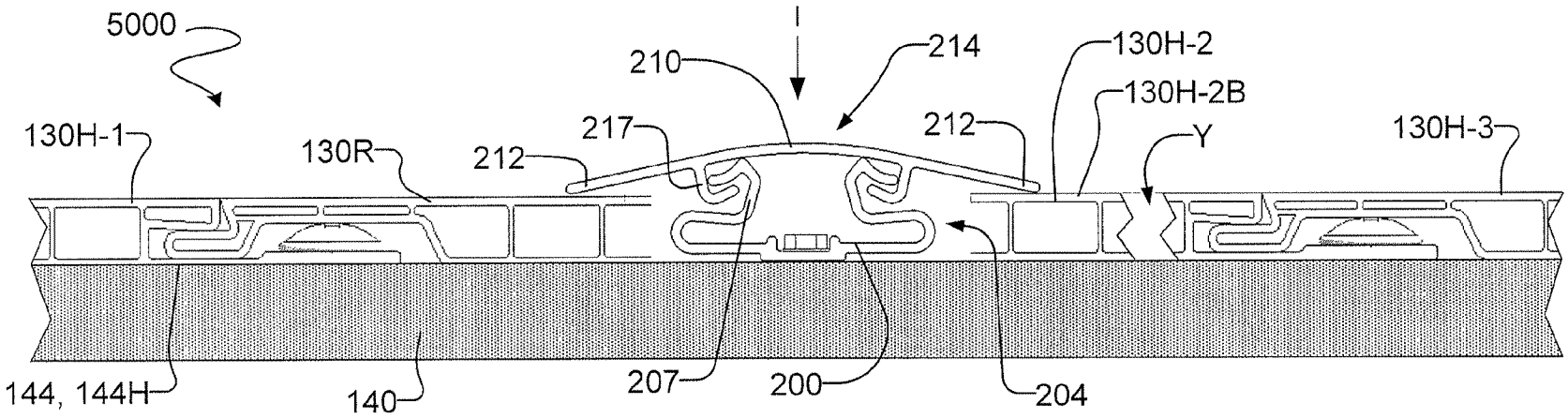

In FIG. 18E, for the sake of clarity, the features of only one of arms 217 and only one of arms 207 are labelled. In FIG. 18F, for the sake of clarity, the features of arms 217 and arms 207 are not labelled. The features of arms 217 and arms 207 in FIGS. 18E and 18F can be identified by reference to the corresponding features of FIGS. 16 and 17.

In FIG. 18F, trim piece 210 is connected to base piece 200 by application of force (e.g. mallet blows) against trim piece 210 toward base piece 200 in direction I. Connector 214 of trim piece 210 and connector 204 of base piece 200 may form a connection that is similar to the connection between connectors 124 and 114 as described above and as illustrated in FIGS. 8A and 8B. Also, wings 212 of trim piece 210 may contact repair panel 130R and second piece 130H-2B, respectively, in a manner that is similar to the contact between wings 122 and panels 130B-n and 130C-1, respectively, as described above and as illustrated in FIGS. 8A and 8B.

Using the method illustrated in FIGS. 18A-18F, damaged panel 130H-2 may be repaired with removing any adjacent panels (e.g. panels 130H-1 and 130H-3). This may save considerable time and expense.

To repair a panel (e.g. panel 130) adjacent to a corner base piece (e.g. inside corner base piece 110, outside corner base piece 160, obtuse corner base piece 180), the corner trim piece (e.g. inside corner trim piece 120, outside corner trim piece 170, obtuse corner trim piece 190) connected to the corner base piece may be removed. In some embodiments the corner trim piece may be removed from the corner base piece by grasping the corner trim piece (e.g. by its wings) and pulling it. In some embodiments, the corner trim piece may be removed from the corner base piece by sliding the corner trim piece up or down relative to the corner base piece. In some embodiments, the corner trim piece may be removed by being cut (e.g. down its center in the longitudinal dimension). After the corner trim piece is removed and a replacement panel is moved into position adjacent to the corner base piece, a corner trim piece (e.g. the original corner trim piece or a new corner trim piece) may be connected to the corner base piece so that a wing of the corner trim piece secures an end (e.g. a cut end, a male end, a female end) of the replacement panel.

When a corner trim piece or a repair strip trim piece is damaged, it may be removed (e.g. using one of the methods described above) and a new trim piece may be installed (e.g. using one of the methods described above).

Panels may be configured to have any combination of male ends, female ends, and cut ends along their four edges. Corner base pieces and repair strip base pieces may be configured to receive any combination of male ends, female ends, and cut ends on their two opposing sides.

The structure claddings in the illustrated embodiments are not necessarily to scale. In some embodiments, some panels may be larger than others.

Panels 130 are double-walled, but in other embodiments there may be panels with greater or fewer numbers of walls. In some embodiments, panels 130 contain insulating material.

The structure cladding and repair pieces of this invention may be made of any suitable material, including plastic, metal, etc. They may be manufactured by any suitable method, including extrusion, coextrusion, injection molding, casting, machining, etc. In some embodiments, different components of the same part may be made of different materials (e.g. a part may have both plastic and rubber components; such a part may be manufactured by coextrusion).

In some embodiments the structure cladding and repair pieces may be made of material that is suitable for food storage applications. In some embodiments, the interfaces between adjacent panels and the interfaces between panels and trim pieces are tight enough to be suitable for food storage applications. In some applications these interfaces are watertight.

The structure cladding and repair pieces may be attached to a structure by any suitable means, including fasteners (e.g. screws, nails, bolts, etc.), adhesives, magnets, Velcro® etc.

The connections between the base pieces and the trim pieces described herein may be referred to as "snap together" connections. In some embodiments, other designs of "snap together" connections may be used. For example: connections with greater or fewer than two arms and two hooked portions, "ball and socket" connections, "tongue and groove" connections, etc. In some embodiments, other types of connections between base pieces and trim pieces may be used. For example: adhesive connections, magnetic connections, Velcro® connections, etc.

Some embodiments of the invention comprise structure claddings with no "sharp corners" (i.e. structure claddings with a minimum radii of curvature (e.g. 0.1 cm, 1 cm, 5 cm, and/or the like)). Structure claddings with no sharp corners may be easier to clean, and may be suitable for food storage applications and/or may comply with food storage regulations.

Although the operations of the methods herein are shown and described in a particular order, the order of the operations of each method may be altered so that certain operations may be performed in an inverse order or so that certain operation may be performed, at least in part, concurrently with other operations.

Where a component is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Those skilled in the art will appreciate that directional conventions such as "vertical", "transverse", "horizontal", "upward", "downward", "forward", "backward", "inward", "outward", "vertical", "transverse" and the like, used in this description and any accompanying claims (where present) depend on the specific orientation of the apparatus described. Accordingly, these directional terms are not strictly defined and, unless the context dictates otherwise, should not be interpreted narrowly.

Unless the context clearly requires otherwise, throughout the description and any accompanying claims (where present), the words "comprise," "comprising," and the like are to be construed in an inclusive sense, that is, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. Additionally, the words "herein," "above," "below," and words of similar import, shall refer to this document as a whole and not to any particular portions. Where the context permits, words using the singular or plural number may also include the plural or singular number respectively. The word "or," in reference to a list of two or more items, covers all of the following interpretations of the word: any of the items in the list, all of the items in the list, and any combination of the items in the list.

While a number of exemplary aspects and embodiments have been discussed above, those of skill in the art will recognize certain modifications, permutations, additions and sub-combinations thereof. As will be apparent to those skilled in the art in the light of the foregoing disclosure, many alterations and modifications are possible in the practice of this invention and the appended claims should be given the broadest reasonable interpretation consistent with this disclosure.

What is claimed is:

1. A cladding kit for a structure cladding, the structure cladding comprising a first panel that extends away from a structure location along a first surface portion of the structure and a second panel that extends away from the structure location along a second surface portion of the structure, the first and second surface portions on opposed sides of the structure location, the cladding kit comprising:

a base piece couplable to the structure at the structure location, the base piece comprising a base connector; and a trim piece comprising first and second wings and a trim connector shaped to make a connection with the base connector to thereby couple the trim piece to the base piece;

wherein:

the first wing is shaped to contact, and be deformed by, the first panel when the connection is made and to exert restorative force against the first panel after the connection is made;

the second wing is shaped to contact, and be deformed by, the second panel when the connection is made and to exert restorative force against the second panel after the connection is made;

the base connector comprises a plurality of base connector hook projections that each define a base connector hook concavity and the trim connector comprises a plurality of trim connector hook projections that each define a trim connector hook concavity;

each base connector hook concavity defines a first acute angle and each trim connector hook concavity defines a second acute angle; and the base connector hook projections and the trim connector hook connections are shaped such that making the connection involves extending the base connector hook projections into the trim connector hook concavities and extending the trim connector hook projections into the base connector hook concavities.

2. A cladding kit according to claim 1 wherein:

the first and second wings define a first wing angle when they are in an undeformed state;

the first and second wings define a second wing angle after the connection is made; and the first wing angle is larger than the second wing angle.

3. A cladding kit according to claim 1 wherein the structure location is a corner of the structure.

4. A cladding kit according to claim 1 wherein the structure location is a flat surface of the structure.

5. A cladding kit according to claim 1 wherein the base piece comprises a first extending portion shaped to extend along the first surface portion of the structure.

6. A cladding kit according to claim 5 wherein an end of the first extending portion distal from the structure location comprises a deformation component.

7. A cladding kit according to claim 6 wherein the deformation component is shaped so that when a first force is applied against the deformation component in a first direction parallel to the first surface portion, the deformation component deforms in the first direction and exerts a restorative force in a second direction opposed to the first direction.

8. A cladding kit according to claim 6 wherein an end of the deformation component distal from the structure location comprises a tip defining a tip surface that extends away from the first surface portion as it extends away from the structure location.

9. A cladding kit according to claim 8 wherein the tip is shaped and located to guide a first panel portion of the first panel between the first extending portion and the first surface portion as the first panel moves toward the structure location.

10. A cladding kit according to claim 1 wherein the base piece comprises a second extending portion shaped to extend along the second surface portion of the structure.

11. A cladding kit according to claim 10 wherein the second extending portion is shaped to extend between the second surface portion of the structure and the second panel.

12. A cladding kit according to claim 10 wherein the second extending portion comprises a mounting tab for mounting the base piece to the structure.

13. A cladding kit according to claim 10 wherein the second extending portion comprises a nub, the nub defining a nub surface that extends away from the second surface portion as it extends towards the structure location.

14. A cladding kit according to claim 13 wherein the nub is shaped and located to guide the second panel away from the second surface portion as the second panel moves toward the structure location.

15. A cladding kit according to claim 1 wherein the base connector and the trim connector are shaped such that making the connection comprises deformation of one or both of the base connector and the trim connector.

16. A cladding kit according to claim 1 wherein:

the base connector and the trim connector are shaped such that making the connection involves a first amount of deformation of one or both of the base connector and the trim connector;

a second amount of deformation of one or both of the base connector and the trim connector remains after the connection is made; and the second amount of deformation is less than the first amount of deformation.

17. A cladding kit according to claim 1 wherein:

first and second base connector hook projections of the plurality of base connector hook projections define first and second base connector beveled surfaces;

first and second trim connector hook projections of the plurality of trim connector hook projections define first and second trim connector beveled surfaces; and the first and second base connector beveled surfaces and the first and second trim connector beveled surfaces are shaped such that making the connection involves bearing the first base connector beveled surface against the first trim connector beveled surface and bearing the second base connector beveled surface against the second trim connector beveled surface.

18. A cladding kit according to claim 17 wherein the first and second base connector beveled surfaces and the first and second trim connector beveled surfaces are shaped such that making the connection involves at least one of:

at least one of: deforming the first and second base connector hook projections away from each other; and deforming the first and second trim connector hook projections toward each other so that the first and second trim connector hook projections enter a space between the first and second base connector hook projections; and at least one of: deforming the first and second trim connector hook projections away from each other; and deforming the first and second base connector hook projections toward each other so that the first and second base connector hook projections enter a space between the first and second trim connector hook projections.

19. A cladding kit according to claim 1 wherein at least one of:

the base piece comprises a preliminary connector shaped to form a preliminary connection with the trim connector; and the trim piece comprises a preliminary connector shaped to form a preliminary connection with the base connector.

20. A cladding kit according to claim 19 wherein the preliminary connector is shaped like an arrow in transverse cross-section, wherein the arrow comprises arrow protrusions at a distal end of a stem, the arrow protrusions extending in transverse directions by amounts greater than a transverse dimension of the stem.

21. A cladding kit according to claim 1 wherein a distal end of each of the plurality of trim connector hook projections extends away from the structure and a distal end of each of the plurality of base connector hook projections extends toward the structure when the connection is made.

22. A cladding kit for a structure cladding, the structure cladding comprising a first panel that extends away from a structure location along a first surface portion of the structure and a second panel that extends away from the structure location along a second surface portion of the structure, the first and second surface portions on opposed sides of the structure location, the cladding kit comprising:

a base piece couplable to the structure at the structure location, the base piece comprising a base connector; and a trim piece comprising first and second wings and a trim connector shaped to make a connection with the base connector to thereby couple the trim piece to the base piece;

wherein:

the first wing is shaped to contact, and be deformed by, the first panel when the connection is made and to exert restorative force against the first panel after the connection is made;

the second wing is shaped to contact, and be deformed by, the second panel when the connection is made and to exert restorative force against the second panel after the connection is made;

the base piece comprises a first extending portion shaped to extend along the first surface portion of the structure;

an end of the first extending portion distal from the structure location comprises a deformation component;

the deformation component is shaped so that when a first force is applied against the deformation component in a first direction parallel to the first surface portion, the deformation component deforms in the first direction and exerts a restorative force in a second direction opposed to the first direction;

the deformation component comprises a plurality of segments;

the plurality of segments define a plurality of segment corners;

the plurality of segment corners define a plurality of segment corner angles; and deformation of the deformation component comprises reducing the segment corner angles and thereby reducing the overall length of the deformation component.

23. A cladding apparatus for a structure cladding, the structure cladding comprising a first panel that extends away from a structure location along a first surface portion of the structure and a second panel that extends away from the structure location along a second surface portion of the structure, the first and second surface portions on opposed sides of the structure location and the cladding apparatus comprising:

a base piece coupled to the structure at the structure location, the base piece comprising a base connector; and a trim piece comprising first and second wings and a trim connector coupled to the base connector to form a connection therebetween and to thereby couple the trim piece to the base piece;

wherein:

the first wing is shaped to contact, and be deformed by, the first panel when the connection is made between the trim connector and the base connector and to exert restorative force against the first panel after the connection is made;

the second wing is shaped to contact, and be deformed by, the second panel when the connection is made between the trim connector and the base connector and to exert restorative force against the second panel after the connection is made;

the base connector comprises a plurality of base connector hook projections that each define a base connector hook concavity and the trim connector comprises a plurality of trim connector hook projections that each define a trim connector hook concavity;

each base connector hook concavity defines a first acute angle and each trim connector hook concavity defines a second acute angle; and the base connector hook projections and the trim connector hook connections are shaped such that making the connection involves extending the base connector hook projections into the trim connector hook concavities and extending the trim connector hook projections into the base connector hook concavities.

24. A method for lining a corner of a structure with a structure cladding, the structure cladding comprising a first panel that extends away from the corner of the structure along a first surface portion of the structure and a second panel that extends away from the corner of the structure along a second surface portion of the structure, the first and second surface portions on opposed sides of the structure location and the method comprising:

coupling a base piece to the structure at the corner of the structure;

providing a trim piece comprising first and second wings; and coupling the trim piece to the base piece to make a connection therebetween;

wherein coupling the trim piece to the base piece to make the connection comprises:

contacting the first wing to the first panel and exerting force which causes the contact between the first wing and the first panel to deform the first wing; and contacting the second wing to the second panel and exerting force which causes the contact between the second wing and the second panel to deform the second wing; wherein:

after the connection is made between the trim piece and the base piece, the first wing exerts restorative force against the first panel and the second wing exerts restorative force against the second panel;

the base connector comprises a plurality of base connector hook projections that each define a base connector hook concavity and the trim connector comprises a plurality of trim connector hook projections that each define a trim connector hook concavity;

each base connector hook concavity defines a first acute angle and each trim connector hook concavity defines a second acute angle; and the base connector hook projections and the trim connector hook connections are shaped such that making the connection involves extending the base connector hook projections into the trim connector hook concavities and extending the trim connector hook projections into the base connector hook concavities.

25. A method for replacing at least a portion of a particular panel of a structure cladding, the structure cladding comprising a plurality of edge-adjacent panels which line a surface of a structure, the method comprising:

removing a first portion of the particular panel from the surface of the structure to leave a remaining portion of the particular panel attached to the surface of the structure;

mounting a base piece to the structure at a base location adjacent to the remaining portion of the particular panel;

locating a replacement panel along the surface of the structure at a replacement panel location, the replacement panel location on a side of the base piece opposite that of the remaining portion of the particular panel; and coupling a trim piece comprising a first wing to the base piece to form a connection therebetween; wherein:

coupling the trim piece to the base piece comprises contacting the first wing to the replacement panel and exerting force which causes the contact between the first wing and the replacement panel to deform the first wing;

after the connection is made between the trim piece and the base piece, the first wing exerts restorative force against the replacement panel;

the base connector comprises a plurality of base connector hook projections that each define a base connector hook concavity and the trim connector comprises a plurality of trim connector hook projections that each define a trim connector hook concavity;

each base connector hook concavity defines a first acute angle and each trim connector hook concavity defines a second acute angle; and the base connector hook projections and the trim connector hook connections are shaped such that making the connection involves extending the base connector hook projections into the trim connector hook concavities and extending the trim connector hook projections into the base connector hook concavities.

* * * * *